US009815182B2

(12) United States Patent
Ikuta

(10) Patent No.: US 9,815,182 B2
(45) Date of Patent: Nov. 14, 2017

(54) POWER TOOL

(71) Applicant: MAKITA CORPORATION, Anjo-shi, Aichi (JP)

(72) Inventor: Hiroki Ikuta, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 480 days.

(21) Appl. No.: 14/491,542

(22) Filed: Sep. 19, 2014

(65) Prior Publication Data

US 2015/0075827 A1 Mar. 19, 2015

(30) Foreign Application Priority Data

Sep. 19, 2013 (JP) ..... 2013-194716
Sep. 19, 2013 (JP) ..... 2013-194717

(51) Int. Cl.
*B25B 21/00* (2006.01)
*B25B 15/06* (2006.01)
*B25F 5/00* (2006.01)

(52) U.S. Cl.
CPC ..... *B25B 21/00* (2013.01); *B25B 15/06* (2013.01); *B25F 5/001* (2013.01)

(58) Field of Classification Search
CPC ..... B25B 21/00; B25B 15/06; B25F 5/001
USPC ..... 173/13, 15, 216, 217
See application file for complete search history.

(56) References Cited

U.S. PATENT DOCUMENTS 4,809,572 A * 3/1989 Sasaki ..... B25B 23/0064 81/429
5,134,909 A * 8/1992 Sasaki ..... B25B 21/00 173/176
5,372,206 A * 12/1994 Sasaki ..... B25B 21/00 173/178
5,735,183 A 4/1998 Sasaki et al.
7,712,546 B2 * 5/2010 Tokunaga ..... B25B 21/00 173/146
2001/0010268 A1 * 8/2001 Tokunaga ..... B25B 21/02 173/205
2010/0236889 A1 9/2010 Sato
2012/0160530 A1 6/2012 Ikuta et al.

FOREIGN PATENT DOCUMENTS

CN 102528718 A 7/2012
JP H03-100076 U 10/1991
JP H08-267367 A 10/1996
JP 2003-231065 A 8/2003
(Continued)

OTHER PUBLICATIONS

Sep. 18, 2015 Office Action issued in Chinese Patent Application No. 201410476001.3.

(Continued)

*Primary Examiner* — Nathaniel Chukwurah
(74) *Attorney, Agent, or Firm* — Oliff PLC

(57) ABSTRACT

A screw driver (100) which comprises a motor (110) and a rotation transmission mechanism (120) is provided. The rotation transmission mechanism (120) comprises a driving gear (125), a spindle (150), a roller (141) and a retainer (130). The retainer (130) moves the roller (140) in a circumference direction of the spindle (150) and thereby a position of the roller (140) between a transmittable position and a non-transmittable position is switched.

20 Claims, 34 Drawing Sheets

(56) References Cited

FOREIGN PATENT DOCUMENTS

| | | | |
|---|---|---|---|
| JP | 2005-299855 | A | 10/2005 |
| JP | 2009-101499 | A | 5/2009 |
| JP | 2009-101501 | A | 5/2009 |
| JP | 2009-297838 | A | 12/2009 |
| JP | A-2012-135842 | | 7/2012 |

OTHER PUBLICATIONS

Feb. 11, 2015 Extended Search Report issued in European Application No. 14185339.0.
Jan. 5, 2017 Office Action issued in Japanese Patent Application No. 2013-194716.
Dec. 15, 2016 Office Action issued in Japanese Patent Application No. 2013-194717.

* cited by examiner

POWER TOOL

CROSS REFERENCE TO RELATED APPLICATION

The present application claims priority from Japanese Patent Applications No. 2013-194716 filed on Sep. 19, 2013, and No. 2013-194717 filed on Sep. 19, 2013, the entire contents of which are incorporated by reference herein.

FIELD OF THE INVENTION

The present invention relates to a power tool which rotationally drives a tool bit.

BACKGROUND OF THE INVENTION

Japanese Unexamined Patent Application Publication No. 2012-135842 discloses a screw driver which rotationally drives a driver bit. In the screw driver described above, a roller pushes a roller holding member while rolling during a screw operation and thereby rotation of a driving gear is transmitted to a spindle.

SUMMARY OF THE INVENTION

Problem to be Solved by the Invention

In the screw driver described above, since the roller pushes the roller holding member while rolling, friction wear on the roller and the roller holding member may be occurred due to the rolling of the roller.

Accordingly, an object of the present invention is, in consideration of the above described problem, to provide an improved technique for transmitting rotation of a motor to a tool bit in a power tool.

Means for Solving the Problem

Above-mentioned problem is solved by the present invention. According to a preferable aspect of the invention, a power tool which rotationally drives a tool bit is provided. The power tool comprises a motor which includes an output shaft, and a rotation transmission member which transmits rotation of the output shaft to the tool bit and thereby rotationally drives the tool bit. The power tool comprises a driving member which includes a rotation shaft, the driving member being rotationally driven by the motor, a driven member to which the tool bit is attached, the driven member being disposed coaxially with the rotation shaft, a transmitting member which is disposed between the driving member and the driven member and is movable in a circumference direction of the rotation shaft between a transmittable position in which rotation of the output shaft is transmitted to the driven member via the transmitting member and a non-transmittable position which is different position from the transmittable position with respect to the driving member or driven member, in which the transmission of rotation is interrupted, and a switching member which is configured to switch a position of the transmitting member between the transmittable position and the non-transmittable position by moving in the circumference direction of the rotation shaft with respect to the driven member. The driven member is configured to move between a first position and a second position in an axial direction of the rotation shaft. The switching member is allowed to move in the circumference direction of the rotation shaft with respect to the driven member based on the position of the driven member in the axial direction of the rotation shaft, and the transmitting member is switched between the transmittable position and the non-transmittable position by the movement of the switching member. Typically, the rotation shaft and the tool bit may be provided coaxially or in parallel to each other.

According to this aspect, the transmitting member is switched the transmittable position and the non-transmittable position in the circumference direction of the rotation shaft, therefore the transmitting member is rationally switched in position with respect to the driving member which rotationally drives. As a result, rotation of the driving member is rationally transmitted to the tool bit.

According to a further preferable aspect, the driven member is moved to the second position from the first position by pushing against a workpiece via the tool bit. When the output shaft is rotated in a predetermined first direction and the driven member is positioned in the first position, the switching member is prevented from moving in the circumference direction of the rotation shaft and thereby the switching member holds the transmitting member in the non-transmittable member. Further, when the output shaft is rotated in the first direction and the driven member is moved to the second position from the first position, the switching member is allowed to move in the circumference direction of the rotation shaft and thereby the switching member switches the position of the transmitting member to the transmittable position and the transmitting member transmits rotation of the output shaft in the first direction to the driven member. On the other hand, when the output shaft is rotated in a second direction opposed to the first direction and the driven member is positioned in the first position, the switching member is allowed to move in the circumference direction of the rotation shaft and thereby the switching member switches the position of the transmitting member to the transmittable position and the transmitting member transmits rotation of the output shaft in the second direction is transmitted to the driven member.

According to this aspect, a drive of the tool bit via the driven member is switched based on the rotation directions of the output shaft of the motor and the positions of the driven member. Accordingly, the power tool is rationally driven according to an operational mode. Further, the power tool is configured not to work by an erroneous operation of a user.

According to a further preferable aspect, the rotation transmission mechanism includes an axially movable element which is configured to move in the axial direction of the rotation shaft in accordance with movement of the driven member in the axial direction of the rotation shaft. Further, the axially movable element moves the switching member in the circumference direction of the rotation shaft by moving in the axial direction of the rotation shaft. The axially movable element may be formed integrally with the driven member, on the other hand, the axially movable element may be provided separately from the driven member. In a case that the axially movable element is provided separately from the driven member, the axially movable element is preferably formed as a spherical member.

According to this aspect, since the axially movable element moves the switching member in the circumference direction of the rotation shaft, an axial movement of the axial movable element is changed to a circumference movement of the switching member. Thus, the switching member is rationally moved in the circumference direction by the axial movement of the axial movable element during an operation of the power tool.

According to a further preferable aspect, the axially movable element is configured to normally prevent a relative movement of the switching member with respect to the driven member in the circumference direction. Further, the axially movable element is moved in the axial direction of the rotation shaft by movement of the driven member to the second position from the first position and thereby the relative movement of the switching member is allowed. Further, in a state that the relative movement of the switching member is allowed, when the driving member is rotated, the switching member switches the position of the transmitting member to the transmittable position from the non-transmittable position by rotation of the driving member.

According to this aspect, since the axially movable element is configured to normally prevent the relative movement of the switching member with respect to the driven member in the circumference direction, malfunction of the power tool under the normal situation is prevented. Further, the power tool is configured not to work by an erroneous operation of a user.

According to a further preferable aspect, the power tool is constructed as a screw fastening tool which performs a screw operation in which the tool bit fastens a screw into a workpiece. The power tool comprises a workpiece contact portion which is contactable with a workpiece during the screw operation. Further, in a state that the workpiece contact portion contacts with a workpiece, the driven member moves so as to be close to a workpiece in the axial direction of the tool bit by fastening a screw by the tool bit. Further, the axially movable element moves in the axial direction in accordance with the axial movement of the driven member during the screw operation and thereby the axially movable element moves the switching member in the circumference direction and the switching member switches the position of the transmitting member to the non-transmittable position from the transmittable position. Further, the workpiece contact portion may be formed as a part of a main housing which houses the rotation transmission mechanism, or a locator which is mounted to the main housing.

According to this aspect, since the power tool is constructed as a screw fastening tool, the driven member is switched to the non-transmittable position when a screw is fastened in a predetermined depth into a workpiece during the screw operation. Accordingly, when the screw is screwed into the predetermined depth into a workpiece, the screw operation is automatically finished. Thus, constant mount of screwing of a screw is achieved.

According to a further preferable aspect, one component of the axially movable element and the switching member has a guide portion which extends in the circumference direction of the rotation shaft, and the other component has a contact portion which is contactable with the guide portion. Further, in a state that the guide portion and the contact portion are contacted with each other during the screw operation, the axially movable element moves to be close to the tool bit in the axial direction and thereby the switching member is moved in the circumference direction of the rotation shaft by the axially movable element, and the switching member switches the position of the transmitting member to the transmittable position from the non-transmittable position by movement of switching member in the circumference direction. Preferably, at least one element among the guide portion and the contact portion may have an incline portion which includes an incline surface inclining the axial direction of the rotation shaft. In such a construction, another element moves in the axial direction and in the circumference direction while contacting with the incline portion. Namely, the axial movement and the incline portion cause the circumference movement.

According to this aspect, the axial movement of the axial movable element is changed to the circumference movement of the switching member by contact between the guide portion and the contact portion.

According to other preferable aspect, one component of the driving member and the driven member is formed as a cylinder and the other component is formed as a polygonal column arranged coaxially with the cylinder of said one component. Further, the transmitting member comprises a plurality of transmitting elements each of which is disposed to correspond to each side surface of the polygonal column.

According to this aspect, since the transmitting member is intervened between the cylinder and the polygonal column, the transmitting member is clamped between the driving member and the driven member with a wedge effect. Thus, rotation of the driving member is steadily transmitted to the driven member via the transmitting element.

According to a further preferable aspect, the driven member is disposed inside the driving member, an internal form of the driving member being formed as a cylinder, an external form of the driven member being formed as a polygonal column. Further, the transmitting element is formed as a roller, and each transmitting element is disposed to correspond to each side surface of the polygonal column of the driven member. The roller preferably includes a cylindrical roller or a conical roller.

According to this aspect, since the transmitting member is formed as a roller, the transmitting member moves between the transmittable position and the non-transmittable position while rolling. Thus, friction of the transmitting member is reduced.

According to a further preferable aspect, when the output shaft is rotated in the first direction, the transmitting element belonging to a first group is switched to the transmittable position from the non-transmittable position by pushing the driven member against a workpiece via the tool bit. Further, when the output shaft is rotated in the second direction, in a state that the transmitting element of the first group is held in the non-transmittable position, rest of the transmitting element belonging to a second group being different from the first group is switched to the transmittable position from the non-transmittable position without pushing the driven member against a workpiece.

According to this aspect, since the transmitting member is provided with a plurality of transmitting elements, the transmitting element of the first group and the transmitting element of the second group are respectively utilized based on operational modes. Namely, the transmitting element is rationally used based on rotational directions of the output shaft of the motor.

According to other preferable aspect, a power tool which rotationally drives a tool bit is provided. The power tool comprises a motor which includes an output shaft, and a rotation transmission member which transmits rotation of the output shaft to the tool bit and thereby rotationally drives the tool bit. The rotation transmission mechanism has a driving member which includes a rotation shaft, the driving member being rotationally driven by the motor, and a driven member to which the tool bit is attached. The driven member is configured to be moved from a first position to a second position in an axial direction of the tool bit by pushing against a workpiece via the tool bit. When the output shaft is rotated in a predetermined first direction, the driven member is moved in the second position from the first position by pushing against a workpiece via the tool bit and thereby rotation of the output shaft in the first direction is transmitted from the driving member to the driven member. Namely, when the output shaft is rotated in the first direction, the first position of the driven member is defined as a rotation non-transmittable position in which rotation of the output shaft is not transmitted to the driven member, and the second position of the driven member is defined as a rotation transmittable position in which rotation of the output shaft is transmitted to the driven member. Further, when the output shaft is rotated in a second direction opposed to the first direction, rotation of the output shaft in the second direction is transmitted from the driving member to the driven member in a state that the driven member is positioned in the first position without pushing against a workpiece. Namely, when the output shaft is rotated in the second direction, the first position of the driven member is defined as the rotation transmittable position. Further, when the output shaft is rotated in the second direction, the driven member may be prevented from moving in the axial direction of the tool bit.

According to this aspect, both constructions of (1) a construction in which rotation of the output shaft is transmitted to the tool bit by pushing the transmitted member against a workpiece via the tool bit, and (2) another construction in which rotation of the output shaft is transmitted to the tool bit without pushing the transmitted member against a workpiece via the tool bit are achieved in a single power tool. That is, the power tool is driven based on operational modes.

According to a further preferable aspect, the rotation transmitting mechanism includes a transmitting member which is disposed selectively in a transmittable position in which rotation of the output shaft is transmitted to the driven member via the transmitting member and in a non-transmittable position in which the transmission of rotation is interrupted. The transmitting member is switched in its position between the transmittable position and the non-transmittable position based on a rotation direction of the output shaft and a position of the driven member in the axial direction of the tool bit. Typically, when the output shaft is rotated in the first direction, the transmitting member is positioned in the transmittable position by movement of the driven member from the first position to the second position, and thereby rotation of the driving member in the first direction is transmitted to the driven member via the transmitting member. On the other hand, when the output shaft is rotated in the second direction, the transmitting member is positioned in the transmittable position in a state that the driven member is positioned in the first position, and thereby rotation of the driving member in the second direction is transmitted to the driven member via the transmitting member.

According to a further preferable aspect, since the position of the transmitting member is switched between the transmittable position and the non-transmittable position based on the rotation direction of the output shaft and the position of the driven member in the axial direction of the tool bit, the power tool is rationally driven in accordance with operational modes.

According to a further preferable aspect, the rotation transmitting mechanism includes a switching member which is configured to switch the position of the transmitting member between the transmittable position and the non-transmittable position. Further, the switching member switches the position of the transmitting member between the transmittable position and the non-transmittable position based on the rotation direction of the output shaft and a position of the driven member in the axial direction of the tool bit.

According to a further preferable aspect, the switching member switches the position of the transmitting member by moving in a circumference direction of the rotation shaft. Further, the rotation transmitting mechanism includes an axially movable element which is configured to move in the axial direction of the tool bit in accordance with movement of the driven member in the axial direction of the tool bit. Further, the axially movable element moves the switching member in the circumference direction of the rotation shaft by moving in the axial direction of the tool bit. The axially movable element may be formed integrally with the driven member or formed separately from the driven member. In such a construction in which the axially movable element is provided separately from the driven member, the axially movable element may be formed as a spherical member.

According to this aspect, since the switching member switches the position of the transmitting member by moving in the circumference direction of the rotation shaft, the position of the transmitting member is rationally switched with respect to the rotating driving member. Further, since the switching member is moved in the circumference direction by the axially movable element, the axial movement is changed to the circumferential direction. Thus, the switching member is rationally moved in the circumference direction by the axial movement of the driven member during an operation of the power tool.

According to a further preferable aspect, the switching member is configured to move the transmitting member in the axial direction of the rotation shaft. The switching member may switch the position of the transmitting member in the axial direction of the rotation shaft by utilizing magnetic force.

According to this aspect, the position of the transmitting member is rationally switched by utilizing the magnetic force.

According to a further preferable aspect, the power tool is constructed as a screw fastening tool which performs a screw operation in which the tool bit fastens a screw into a workpiece. The power tool comprises a workpiece contact portion which is contactable with a workpiece during the screw operation. Further, in a state that the workpiece contact portion contacts with a workpiece, the driven member moves to be close to a workpiece in the axial direction of the tool bit by fastening a screw by the tool bit. Further, the switching member is configured to switch the position of the transmitting member between the transmittable position and the non-transmittable position based on a position of the driven member which is moving in the axial direction of the tool bit during the screw operation. Typically, when the driven member is moved to be close to a workpiece during the screw operation, the position of the transmitting member is switched from the transmittable position to the non-transmittable position. Further, the workpiece contact portion may be formed as apart of a main housing which houses the rotation transmission mechanism, or a locator which is mounted to the main housing.

According to this aspect, since the power tool is constructed as a screw fastening tool, the driven member is switched to the non-transmittable position when a screw is fastened in a predetermined depth into a workpiece during the screw operation. Accordingly, when the screw is screwed into the predetermined depth into a workpiece, the screw operation is automatically finished. Thus, constant mount of screwing of a screw is achieved.

Accordingly, an improved technique for transmitting rotation of the motor to the tool bit is provided.

Other objects, features and advantages of the invention will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved power tools and method for using such power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
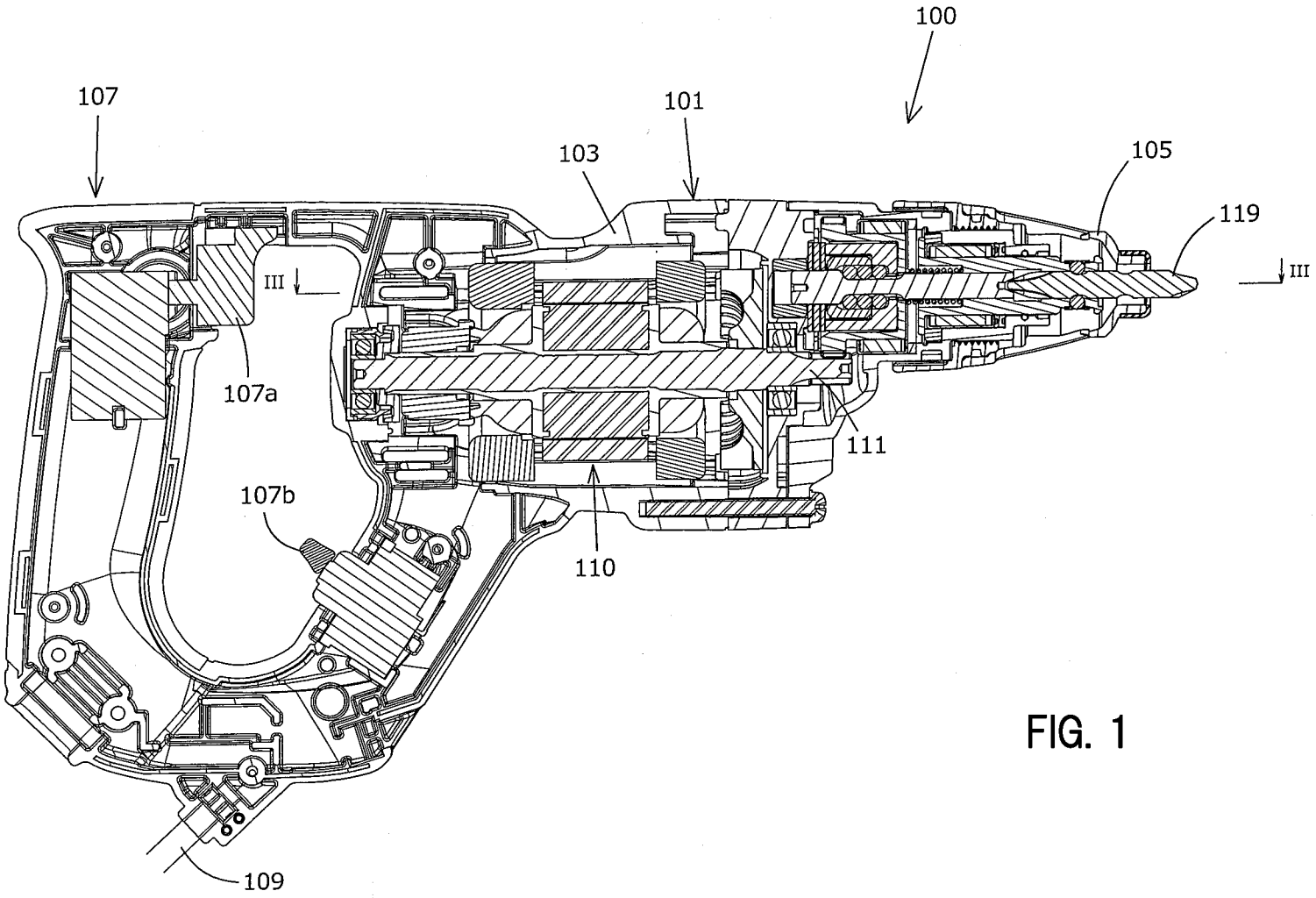
FIG. 1 shows a cross sectional view of a screw driver of a first embodiment of the present invention.

A first embodiment of the present invention is explained with reference to FIG. 1 to FIG. 13. As shown in FIG. 1, a screw driver 100 which performs a screw tightening operation on a workpiece such as a plaster board is constructed as one example of the power tool. The screw driver 100 is mainly provided with a main body 101 and a handle 107.

The main body 101 is mainly provided with a main housing 103 and a locator 105. The main housing 103 houses a motor 110 and a driving mechanism 120. The locator 105 is mounted on a front region of the main housing 103. A tool bit 119 is detachably attached to the driving mechanism 120 at the front region of the main body 101. The tool bit 119 protrudes from the locator 105 and is relatively movable with respect to the locator 105 in an axial direction of the tool bit 119.

The handle 107 is connected to a rear region of the main body 101. A trigger 107*a* and a switch 107*b* are disposed on the handle 107. When the trigger 107*a* is manipulated, current is provided to the motor 101 via a cable 109, and thereby the motor 101 is energized and driven. Further, when the switch 107*b* is manipulated, rotation direction of an output shaft 111 of the motor 110 is switched. That is, a clockwise direction or a counter-clockwise direction is selected by the switch 107*b* and the output shaft 111 is rotated in the selected direction. The motor 110 and the output shaft 111 are examples which correspond to "a motor" and "an output shaft" of the present invention, respectively.

As shown in FIG. 2 to FIG. 6, the driving mechanism 120 is mainly provided with a driving gear 125, a retainer 130, a transmitting mechanism 140, a coil spring 145 and a spindle 150. The driving mechanism 120 is one example which corresponds to "a rotation transmitting mechanism" of the present invention.

Figure 2:
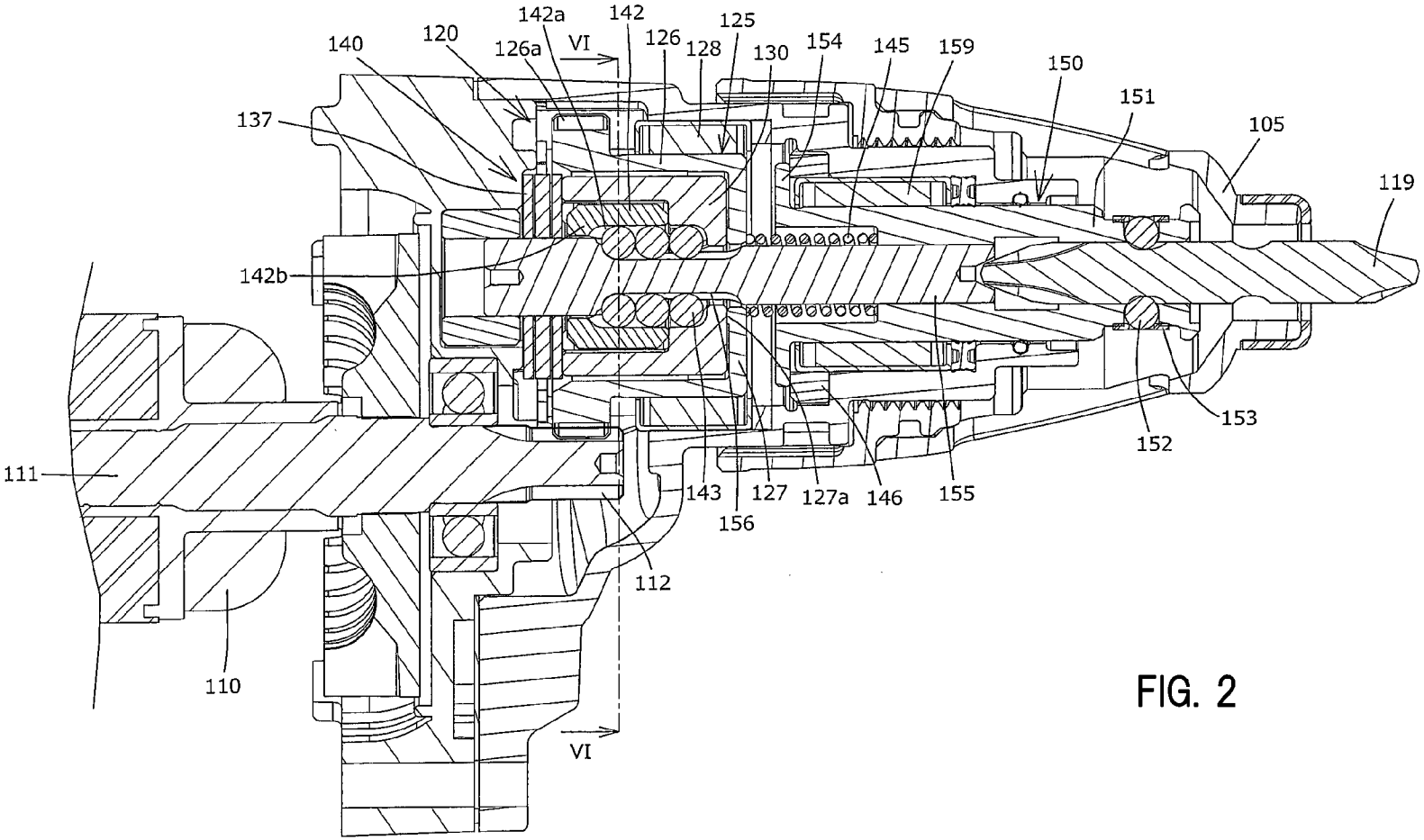
FIG. 2 shows a partial cross sectional view of the screw driver.
Figure 3:
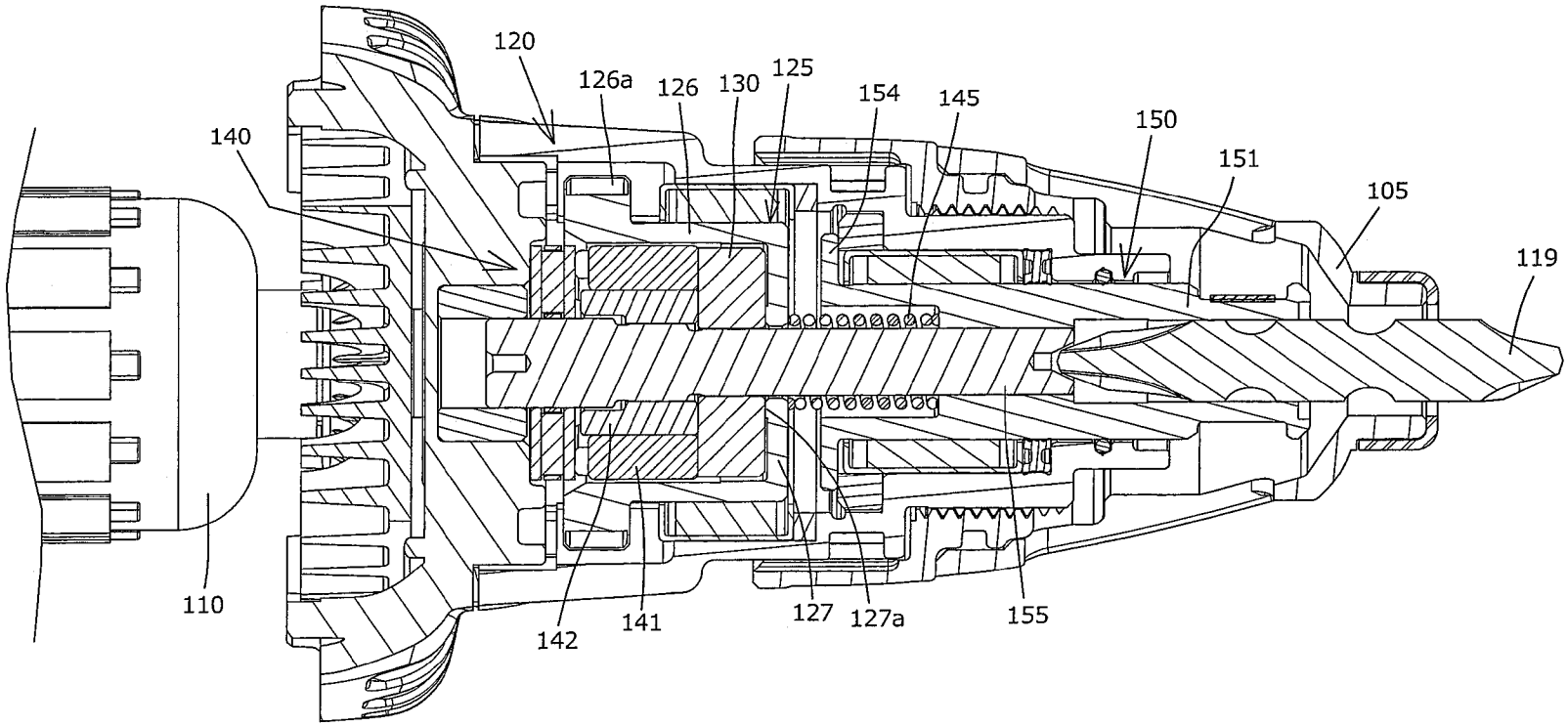
FIG. 3 shows a cross sectional view taken along the III-III line in FIG. 1.

As shown in FIG. 2 and FIG. 3, the driving gear 125 is a substantially cup-shaped member which has a side wall 126 and a bottom wall 127. Inside region of the side wall 126 is formed cylindrically and thereby the driving gear 125 houses the retainer 130 and the transmitting mechanism 140 therein. Gear teeth 126*a* is formed on the side wall 126. The gear teeth 126*a* mesh with gear teeth 112 which are formed on the output shaft 111 of the motor 110. A through-hole through which the spindle 150 penetrates is provided on a center region of the bottom wall 127. A contact portion 127*a* which is contactable with the retainer 130 is defined around the through-hole. Accordingly, the driving gear 125 and the retainer 130 contact with each other via the contact portion 127*a*, that is, other part of the driving gear 125 does not contact with the retainer 130. The driving gear 125 is rotatably supported by a bearing 128. Further, the driving gear 125 is disposed such that it moves in a longitudinal direction of the spindle 150 (axial direction of the tool bit 119). The driving gear 125 is one example which corresponds to "a driving member" of the present invention.

Figure 4:
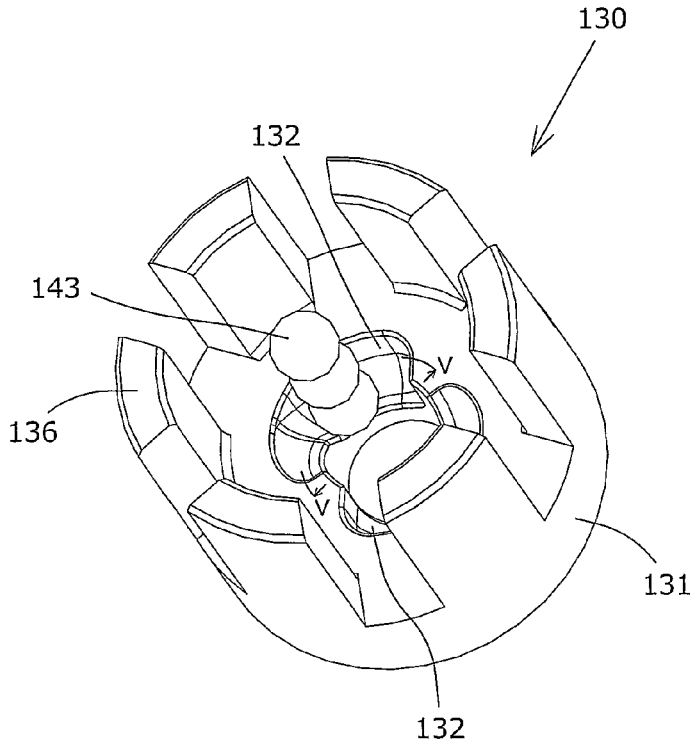
FIG. 4 shows a perspective view of a retainer and balls.

As shown in FIG. 4, the retainer 130 is substantially cylindrical member which comprises a base portion 131 and a side portion 136. The base portion 131 faces the bottom wall 127 of the driving gear 125 and the side portion 136 faces the side wall 126 of the driving gear 125. Further, components other than the retainer 130 and balls 143 are not shown in FIG. 4.

Figure 5:
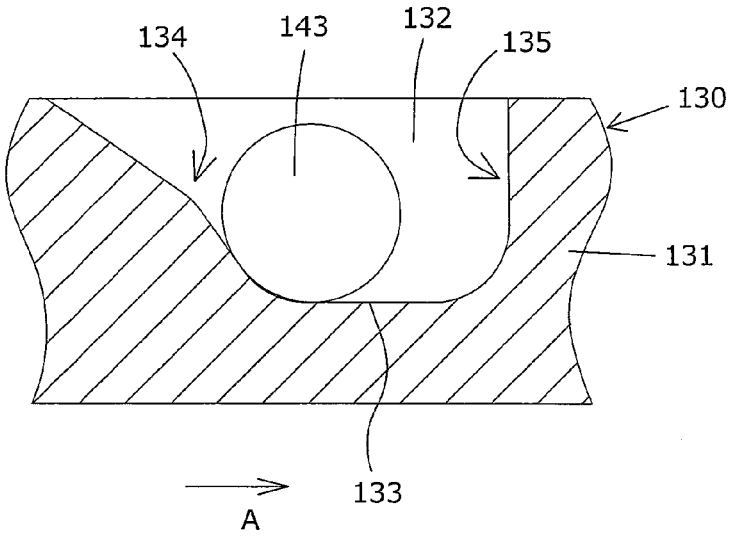
FIG. 5 shows a cross sectional view of a groove of the retainer taken along the V-V line in FIG. 4.

As shown in FIG. 4, two grooves 132 are formed on the base portion 131 along a circumference direction of the retainer 130. As shown in FIG. 5, in each groove 132, a horizontal portion 133 which parallel to the base portion 131, an incline portion 134 which inclines with respect to the horizontal portion 133 and a perpendicular portion 135 which is perpendicular to the horizontal portion 133 are provided. The grooves 132 are configured to contact with the ball 143. Further, only one ball 143 which contacts with the groove 132 among three balls 143 is illustrated in FIG. 5. Other sections of the groove are similarly illustrated.

The side portion 136 is disposed so as to protrude from the base portion 131 in an axial direction of the cylindrical retainer 130. Six side portions 136 are disposed with predetermined interval to one another in a circumference direction of the retainer 130. A roller 141 is disposed between two side portions 136 which are disposed next to each other. As shown in FIG. 2 and FIG. 3, an end portion of the side portion 136 in the axial direction of the retainer 130 is supported by a needle bearing 137, and therefore the retainer 130 is rotatably supported. The retainer 130 is one example which corresponds to "a switching member" of the present invention.

Figure 6:
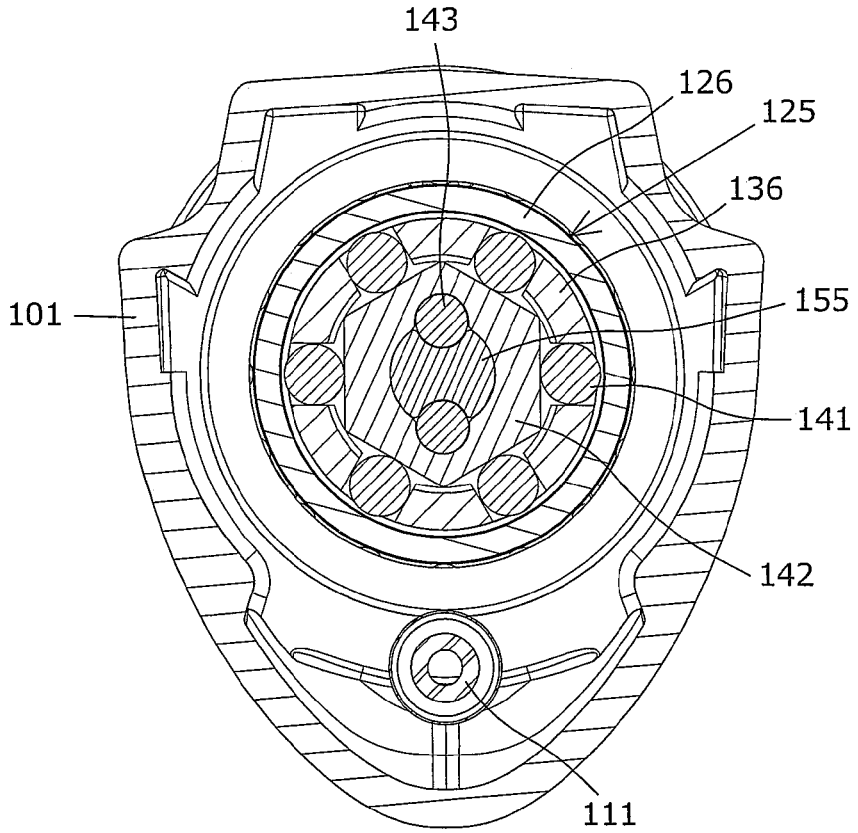
FIG. 6 shows a cross sectional view taken along the VI-VI line in FIG. 2.

As shown in FIG. 2 and FIG. 3, the transmitting mechanism 140 is mainly provided with rollers 141, a transmitted member 142 and the balls 143. The transmitting mechanism 140 is configured to transmit rotation of the driving gear 125 to the spindle 150. As shown in FIG. 6, the transmitted member 142 has a substantially hexagonal shape section. Six rollers 141 are disposed on the outer surface of the transmitted member 142 such that each roller 142 corresponds to each side of the hexagon of the transmitted member 142. The roller 141 is disposed such that a longitudinal direction of the roller 141 is parallel to the axial direction of the spindle 150. When the retainer 130 is rotated, the side portion 136 of the retainer 130 causes the roller 141 to move along the outer surface of the transmitted member 142 in the circumference direction of the transmitted member 142. The roller 141 is one example which corresponds to "a transmitting member" of the present invention.

As shown in FIG. 2, each ball 143 is held by a ball holding groove 142*a* formed on the transmitted member 142 and a ball holding groove 156 formed on the spindle 150. Accordingly, the transmitted member 142 and the spindle 150 are configured to rotate integrally via the balls 143. In each ball holding groove 142*a*, three balls 143 are disposed such that they can move in the axial direction of the spindle 150. Further, a stopping portion 142*b* is formed on the transmitted member 142, and thereby the ball 143 is prevented from moving by the stopping portion 142*b* in the axial direction of the spindle 150.

As shown in FIG. 2 and FIG. 3, the spindle 150 is formed by a substantially cylindrical bit holding portion 151 and a substantially cylindrical rotation transmitting shaft 155. The bit holding portion 151 and the rotation transmitting shaft 155 are coupled integrally to each other. The bit holding portion 151 comprises a bit holding ball 152 and a leaf spring 153, and thereby the bit holding portion 151 detachably holds the tool bit 119. A flange portion 154 is formed on the opposite side to the tool bit 119 in the axial direction of the spindle 150. The flange portion 154 protrudes outwardly in a radial direction of the spindle 150. The flange portion 154 is disposed such that its rear surface faces the driving gear 125 in the axial direction of the spindle 150.

The rotation transmitting shaft 155 is provided such that one end side of the transmitting shaft 155 is connected to the bit holding portion 151 and another end side of the transmitting shaft 155 is penetrated the driving gear 125 and extended to the motor 110 side. Two ball holding grooves 156 are provided in positions opposed by 180 degrees on the rotation transmitting shaft 155 such that the ball holding grooves 156 face two ball holding grooves 142*a* of the transmitted member 142. The ball holding grooves 156 respectively extend in an axial direction of the rotation transmitting shaft 155 (longitudinal direction of the spindle 150).

The spindle 150 described above is rotatably held by a bearing 159. Further, the spindle 150 is movably held in a longitudinal direction of the spindle 150. The spindle 150 is one example which corresponds to "a driven member" of the present invention.

As shown in FIG. 2 and FIG. 3, the coil spring 145 is provided coaxially around the spindle 150 so as to extend in the longitudinal direction of the spindle 150. One end of the coil spring 145 is in contact with the driving gear 125, and the other end is in contact with the spindle 150, and thereby the spindle 150 is biased toward a front region to which the tool bit 119 is attached (toward front side of the screw driver 100). A stopper 146 is provided in front of the flange portion 154. Accordingly, by contact between the stopper 146 and the flange portion 154, the spindle 150 is prevented from moving frontward of the screw driver 100. On the other hand, the driving gear 125 is biased toward rear region (toward rear side of the screw driver 100) which is opposite to the front region in the longitudinal direction of the spindle 150. The driving gear 125 is prevented from moving rearward of the screwdriver 100 by the retainer 130 and the needle bearing 137.

In the screw driver 100 described above, when the trigger 107*a* is manipulated, the motor 110 is turned on and actuated. The driving gear 125 is rotated by rotation of the output shaft 111 of the motor 110. Thereafter, rotation of the driving gear 125 is transmitted to the spindle 150, and thereby the tool bit 119 held by the spindle 150 is rotationally driven.

(Screw Operation)

As shown in FIG. 2, when the output shaft 111 of the motor 110 is rotationally driven in a predetermined direction (forward direction) during a screw operation, torque of the driving gear 125 is transmitted to the retainer 130 via the contact portion 127*a* by friction force. However, as shown in FIG. 2 and FIG. 5, the ball 143 contacts with the incline portion 134 of the retainer 130, thereby the ball 143 prevents the retainer 130 from rotating. Accordingly, rollers 141 are held in each position shown in FIG. 6, therefore the spindle 150 is not driven. The predetermined rotational direction (forward direction) of the output shaft 111 during the screw operation is one example which corresponds to "a first direction" of the present invention. Further, each position of the rollers 141 shown in FIG. 6 is one example which corresponds to "a non-transmittable position" of the present invention.

Figure 7:
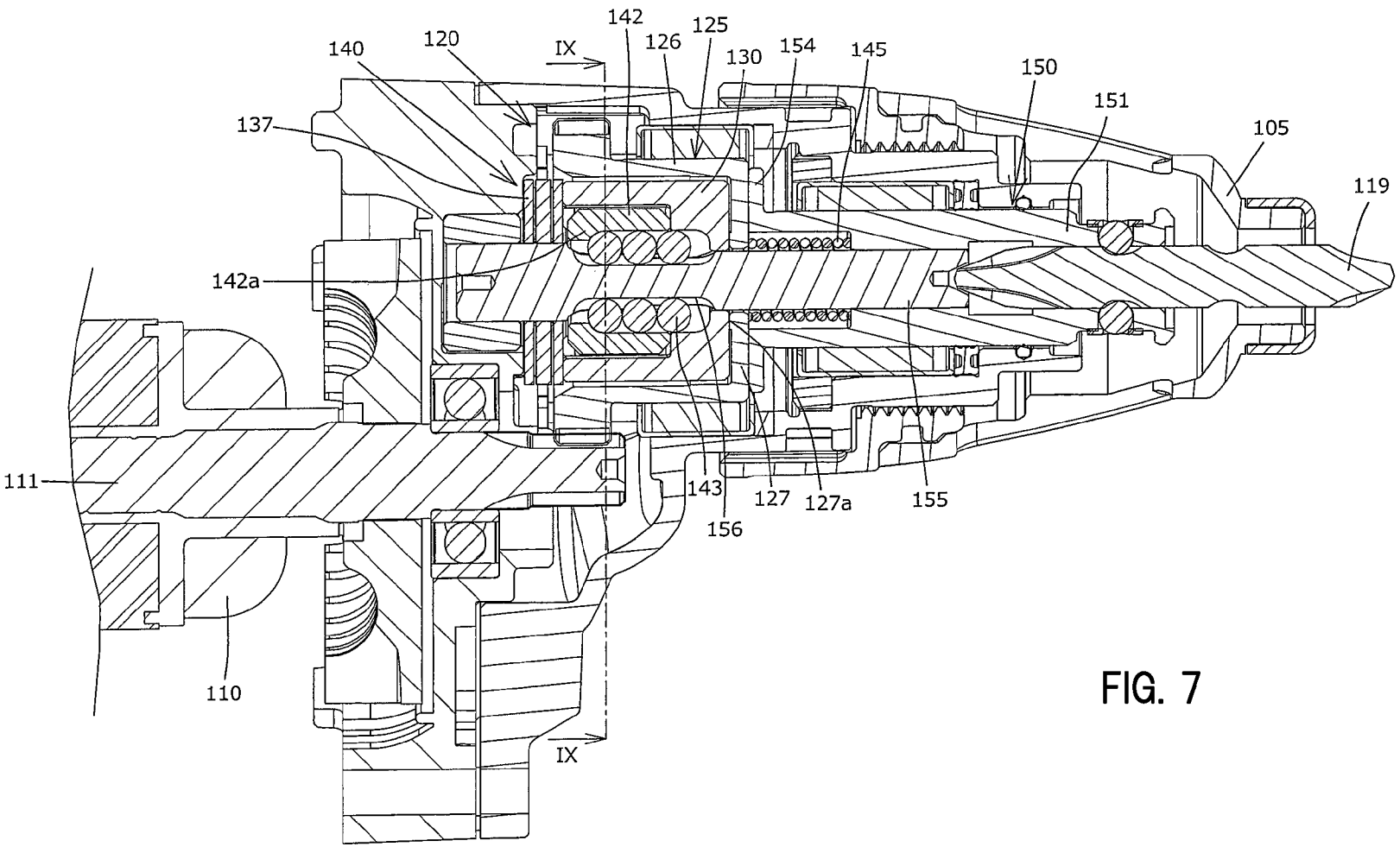
FIG. 7 shows a cross sectional view which corresponds to FIG. 2 in a state of a screw operation.
Figure 8:
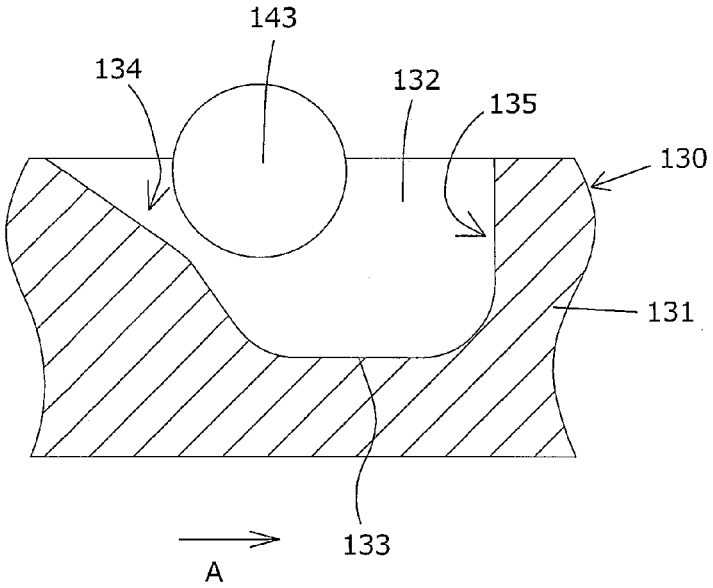
FIG. 8 shows a cross sectional view which corresponds to FIG. 5 in a state of the screw operation.
Figure 9:
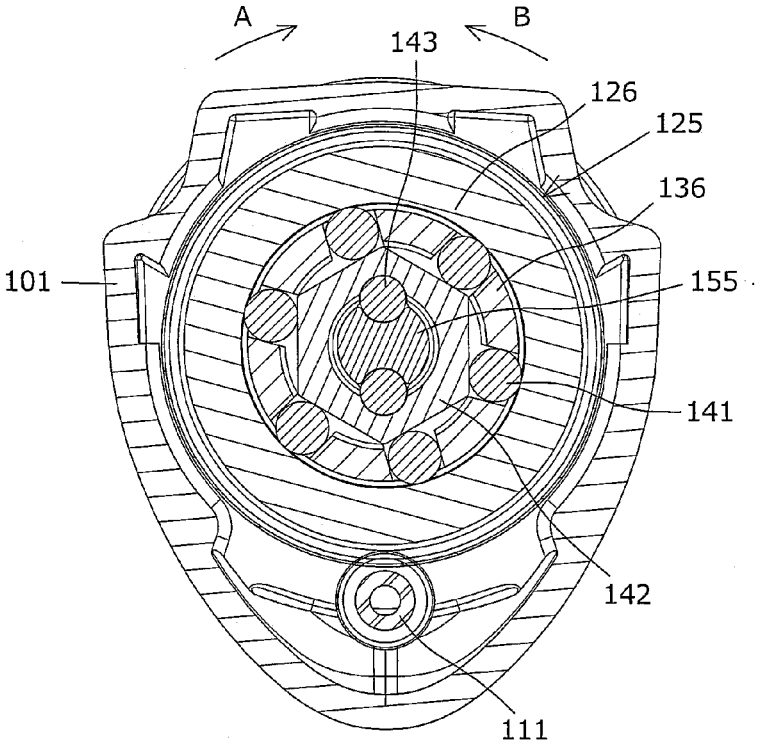
FIG. 9 shows a cross sectional view taken along the IX-IX line in FIG. 7.
Figure 10:
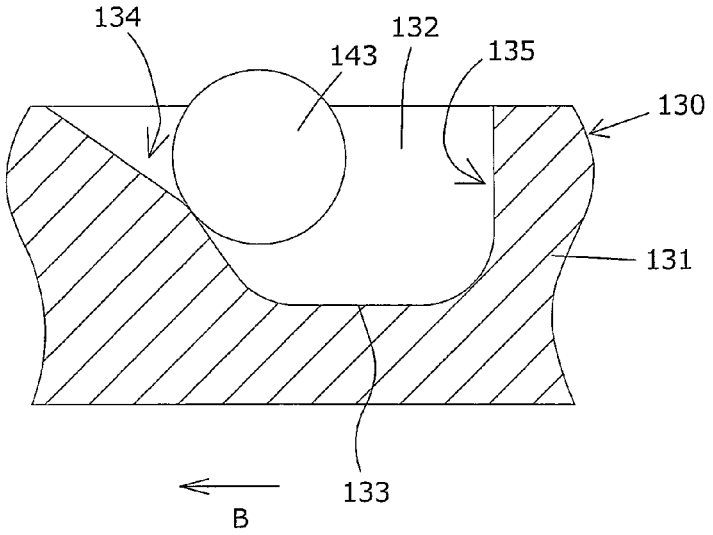
FIG. 10 shows a cross sectional view which corresponds to FIG. 5 in a state of the screw operation.

As shown in FIG. 7, when the tool bit 119 is pushed via a screw (now shown) against a workpiece, the spindle 150 is moved rearward of the screw driver 100 against the biasing force of the coil spring 145. At this time, the balls 143 are moved rearward with movement of the spindle 150. Thus, as shown in FIG. 8 and FIG. 9, contact between the ball 143 and the incline portion 134 is released (canceled), and by friction force between the contact portion 127*a* and the retainer 130, the retainer 130 is rotated in a direction indicated by an arrow A (A-direction). The front position and the rear position of the spindle 150 are examples which correspond to "a first position" and "a second position" of the present invention, respectively. Further, each position of the rollers 141 shown in FIG. 9 is one example which corresponds to "a transmittable position" of the present invention.

The roller 141 is moved by rotation of the retainer 130, and thereby the roller 141 is clamped between the driving gear 125 and the transmitted member 142. As a result, the driving gear 125 and the transmitted member 142 are integrally rotated in the A-direction by a wedge effect of the roller 141. In other words, torque of the driving gear 125 is transmitted to the transmitted member 142. When the transmitted member 142 is rotationally driven, the rotation transmitting shaft 155 (spindle 150) is rotated. Thus, the tool bit 119 held by the spindle 150 is rotationally driven and performs the screw operation.

When the screw operation is performed, a screw is screwed into a workpiece. A front surface of the locator 105 contacts with the workpiece with movement of the screw screwed into the workpiece, and thereby the spindle 150 which holds the tool bit 119 is gradually moved frontward of the screwdriver 100. Accordingly, the balls 143 held in the ball holding groove 156 are moved frontward. Namely, the balls 143 are moved from a position shown in FIG. 8 to a position shown in FIG. 10 and contacts with the incline portion 134 of the groove 132 which is formed on the retainer 130. The locator 105 is one example which corresponds to "a workpiece contact portion" of the present invention.

Figure 11:
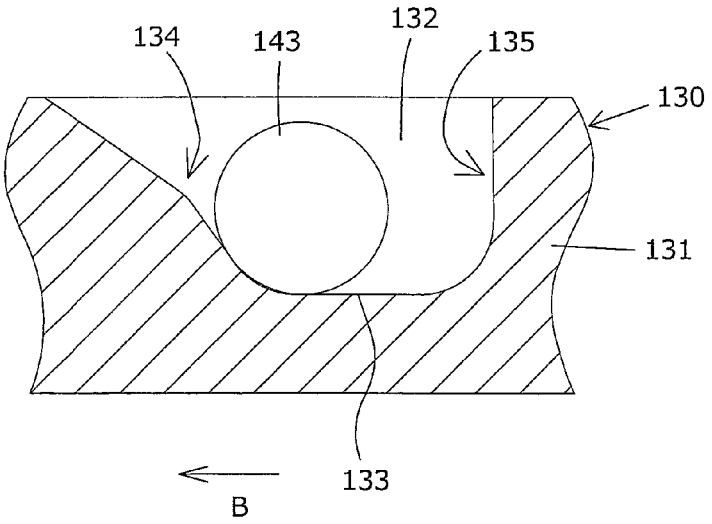
FIG. 11 shows a cross sectional view which corresponds to FIG. 5 at the end of the screw operation.

By screwing the screw into the workpiece in a state that the locator 105 contacts with the workpiece, the spindle 150 is moved forward of the screw driver 100, and the ball 143 pushes the incline portion 134 as shown in FIG. 11. Thus, as shown in FIG. 9, the retainer 130 is rotated in B-direction with respect to the driving gear 125 rotating in the A-direction. As a result, the retainer 130 and the roller 141 are moved into a position indicated in FIG. 6, and thereby transmission of rotation of the driving gear 125 to the transmitted member 142 is interrupted. Accordingly, the screw is screwed in a predetermined depth to the workpiece and the screw operation is finished. Further, the predetermined depth where a screw is screwed into a workpiece is adjustable by a user by changing a mounting position of the locator 105 with respect to the main housing 103 so that a distance between a screw head of the screw held by the tool bit 119 and a front surface of the locator 105 is changed. The ball 143 and the incline portion 134 of the groove 132 are examples which correspond to "a contact portion" and "a guide portion" of the present application, respectively.

(Unscrew Operation)

When a screw screwed into a workpiece is unscrewed from the workpiece, the screw driver 100 rotates the screw in an opposite direction and thereby the screw is unscrewed. At this time, it is not rational that the tool bit 119 pushes the screw in order to actuate (drive) the tool bit 119. Therefore, during an unscrew operation, the screw driver 100 drives the tool bit 119 is driven by the motor 110 without pushing the tool bit 119 rearward.

Figure 12:
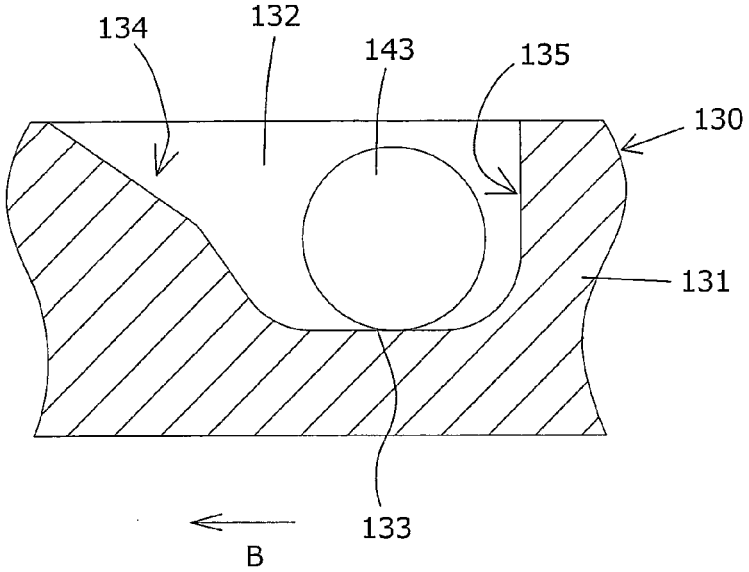
FIG. 12 shows a cross sectional view which corresponds to FIG. 5 in a state of an unscrew operation.

Specifically, the switch 107*b* is switched so that the output shaft 111 of the motor 110 is rotated in a direction (opposite direction) opposite to the forward direction in which the output shaft 111 is rotated in the screw operation. In the state that shown in FIG. 2, when the motor 110 is rotationally driven, torque of the driving gear 125 is transmitted to the retainer 130 via the contact portion 127*a* by friction force. At this time, the retainer 130 shown in FIG. 5 is moved in the B-direction as shown in FIG. 12. That is, the ball 143 is moved far from the incline portion 134 of the groove 132 of the retainer 130 and close to the perpendicular portion 135. In other words, the ball 143 does not prevent rotational movement of the retainer 130. The rotational direction (opposite direction) of the output shaft 111 during the unscrew operation is one example which corresponds to "a second direction" of the present invention.

Figure 13:
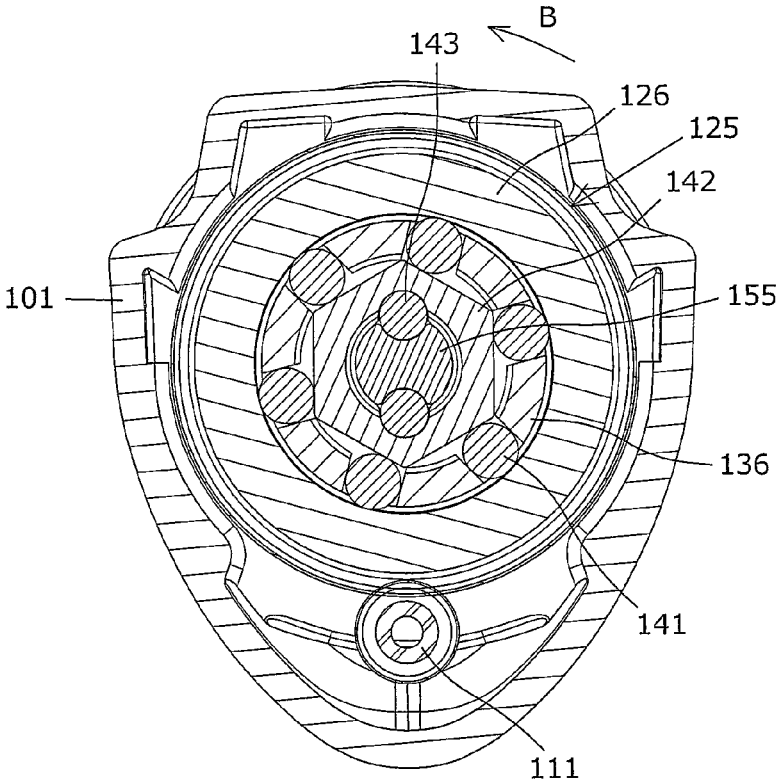
FIG. 13 shows a cross sectional view which corresponds to FIG. 6 in a state of an unscrew operation.

When the retainer 130 is rotated in the B-direction, as shown in FIG. 13, the rollers 141 are moved and clamped between driving gear 125 and the transmitted member 142. As a result, the driving gear 125 and the transmitted member 142 are integrally rotated in the B-direction by a wedge effect of the roller 141. Thus, the tool bit 119 is rotationally driven without pushing the tool bit 119 against a screw and unscrew operation is rationally performed. The position of the roller 141 indicated in FIG. 13 is one example which corresponds to "a transmittable position" of the present invention.

According to the first embodiment, both rotations of the A-direction and the B-direction of the driving gear 125 are transmitted by the same roller 141. That is, when the driving gear 125 is rotated in the A-direction, the tool bit 119 and the spindle 150 are moved in the longitudinal direction and thereby torque of the driving gear 125 is transmitted to the spindle 150 via the roller 141. On the other hand, when the driving gear 125 is rotated in the B-direction, torque of the driving gear 125 is transmitted to the spindle 150 via the roller 141 without axial movement of the tool bit 119 and the spindle 150. Accordingly, based on rational operation aspects, the same roller 141 transmits torque of the motor 110 (driving gear 125) to the tool bit 119 (spindle 150).

Modified Example of the First Embodiment

In the first embodiment, when the unscrew operation is performed, the tool bit 119 is driven without pushing the tool bit 119 against a workpiece via a screw. On the other hand, the tool bit 119 may be driven by pushing the tool bit 119 against a workpiece via a screw.

Figure 14:
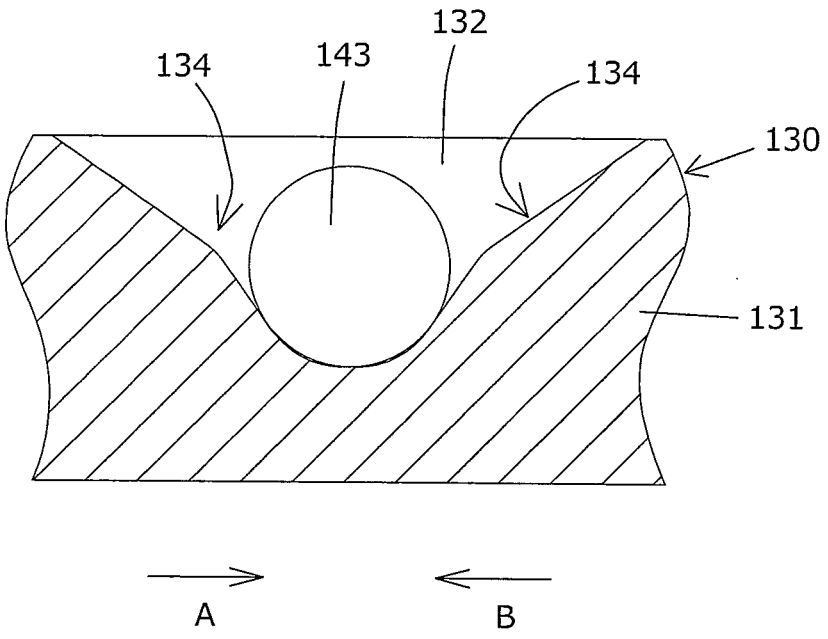
FIG. 14 shows a cross sectional view which corresponds to FIG. 5 of a modified example of the first embodiment.

Specifically, as shown in FIG. 14, an incline portion 134 may be formed instead of the perpendicular portion 135 in the groove 132 of the retainer 130. Accordingly, in a state that the tool bit 119 is not pushed against a workpiece, the retainer 130 is prevented from moving in both of the A-direction and the B-direction by contact between the ball 143 and the incline portion 143. In other words, it is necessary to push the tool bit 119 against a workpiece for driving the tool bit 119 in both of the screw and the unscrew operations.

Second Embodiment

Next, a second embodiment of the present invention is explained with reference to FIG. 15 to FIG. 22. In a screw driver 200, the same components described in the first embodiment are assigned the same symbols as in the first embodiment and explanations thereof are therefore omitted.

As shown in FIG. 15 to FIG. 19, a driving mechanism 220 is mainly provided with a driving gear 225, a retainer 230, a transmitting mechanism 240, the coil spring 145 and the spindle 150. The driving mechanism 220 is one example which corresponds to "a rotation transmitting mechanism" of the present invention.

Figure 15:
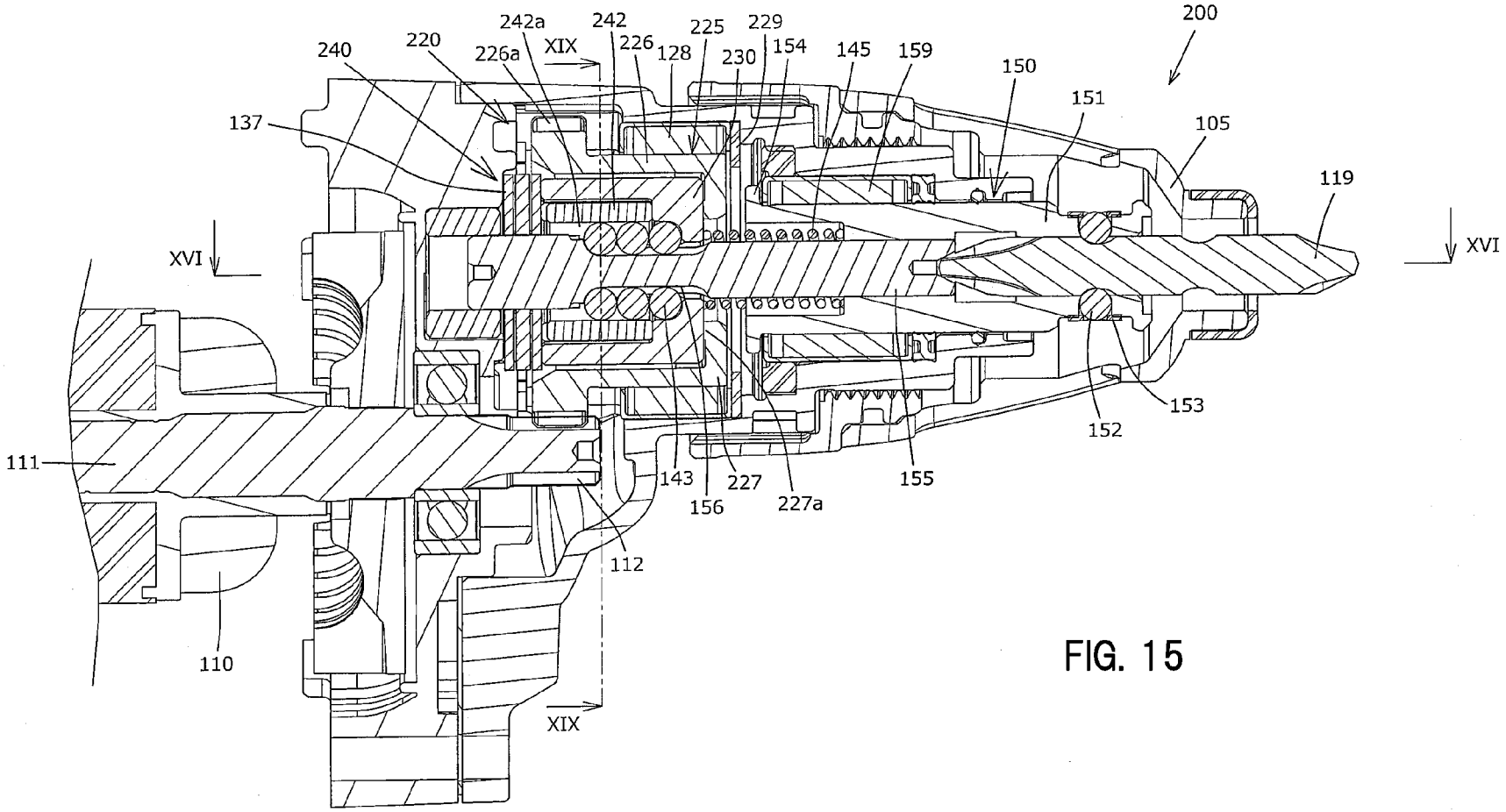
FIG. 15 shows a cross sectional view of a screw driver of a second embodiment of the present invention.
Figure 16:
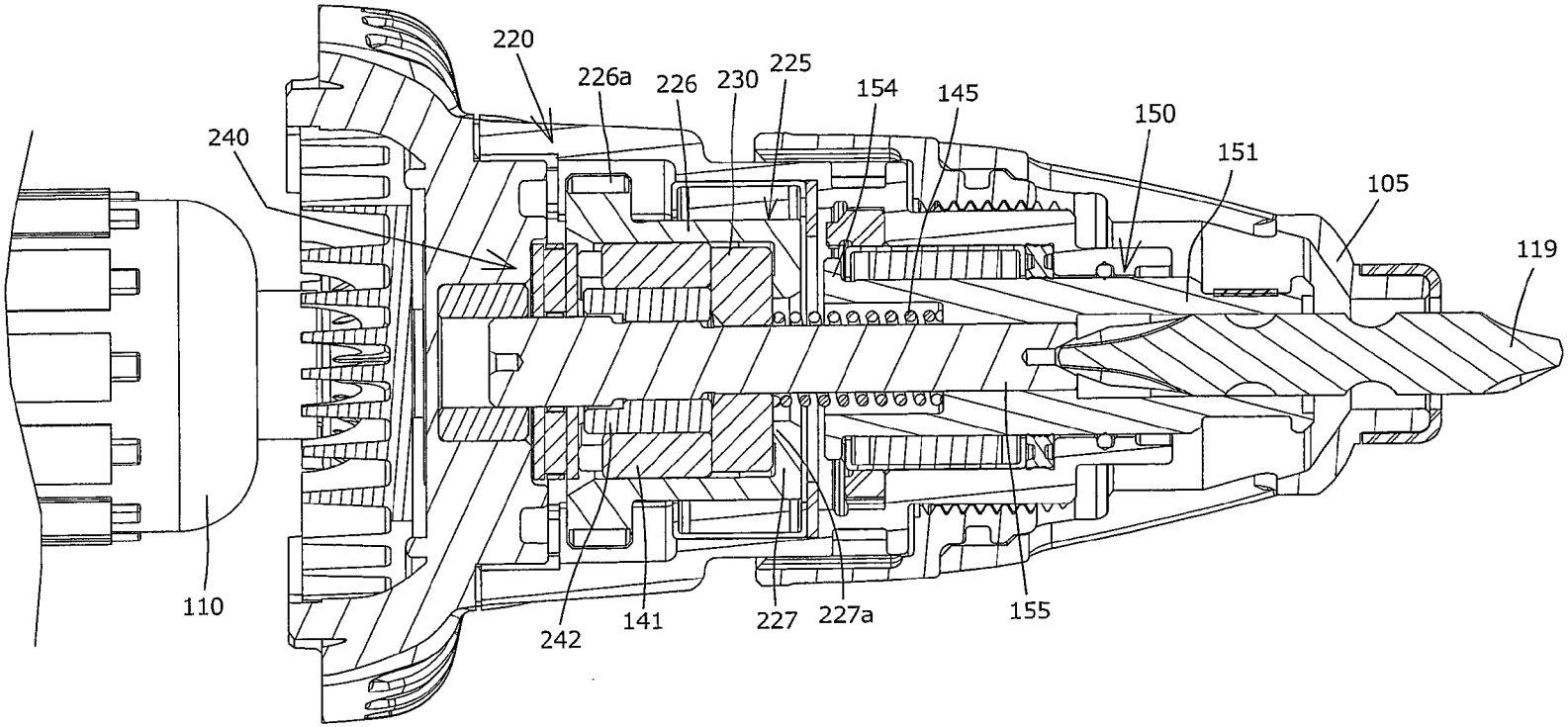
FIG. 16 shows a cross sectional view taken along the XVI-XVI line in FIG. 15.

As shown in FIG. 15 and FIG. 16, the driving gear 225 is a substantially cup-shaped member which has a side wall 226 and a bottom wall 227. Inside region of the side wall 226 is formed cylindrically and thereby the driving gear 225 houses the retainer 230 and the transmitting mechanism 240 therein. Gear teeth **226*a* is formed on the side wall 226. The gear teeth 226*a* mesh with gear teeth 112 which are formed on the output shaft 111 of the motor 110. A through-hole through which the spindle 150 penetrates is provided on a center region of the bottom wall 227. A contact portion 227*a* which is contactable with the retainer 230 is defined around the through-hole. Accordingly, the driving gear 225 and the retainer 230 contact with each other via the contact portion 227*a*, that is, other part of the driving gear 225 does not contact with the retainer 230. The driving gear 225 is disposed such that it moves in a longitudinal direction of the spindle 150 (axial direction of the tool bit 119). Further, a stopper 229 is provided in front of the driving gear 225 and thereby forward movement of the driving gear 225 in the screw driver 200 is prevented by the stopper 229. The driving gear 225** is one example which corresponds to "a driving member" of the present invention.

Figure 17:
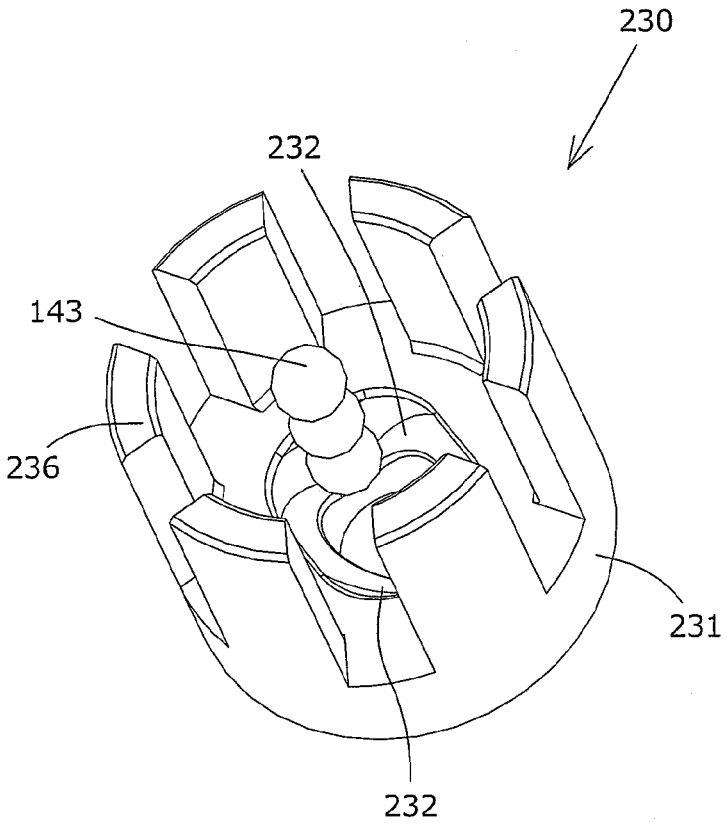
FIG. 17 shows a perspective view of a retainer and balls.

As shown in FIG. 17, the retainer 230 is substantially cylindrical member which comprises a base portion 231 and a side portion 236. The base portion 231 faces the bottom wall 227 of the driving gear 225 and the side portion 236 faces the side wall 226 of the driving gear 225. Further, components other than the retainer 230 and balls 143 are not shown in FIG. 17.

Figure 18:
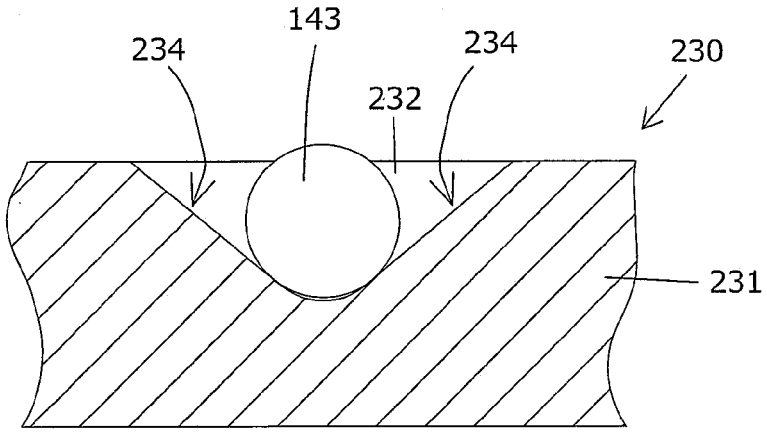
FIG. 18 shows a cross sectional view of a groove of the retainer.

As shown in FIG. 17, two grooves 232 are formed on the base portion 231 along a circumference direction of the retainer 230. As shown in FIG. 18, each groove 232 is formed by two incline portions 234 which incline with respect to the base portion 231. The side portion 236 is, similar to the first embodiment, provided so as to protrude from the base portion 231 in an axial direction of the cylindrical retainer 230. The retainer 230 is one example which corresponds to "a switching member" of the present invention.

Figure 19:
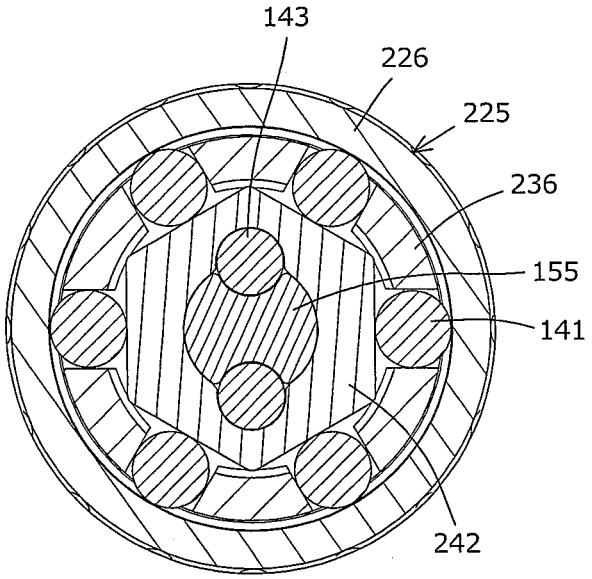
FIG. 19 shows a cross sectional view taken along the XIX-XIX line in FIG. 15.

As shown in FIG. 15 and FIG. 16, the transmitting mechanism 240 is mainly provided with rollers 141, a transmitted member 242 and the balls 143. As shown in FIG. 19, the transmitted member 242 has a substantially hexagonal shape section. Similar to the first embodiment, six rollers 141 are disposed on the outer surface of the transmitted member 242 such that each roller 142 corresponds to each side of the hexagon of the transmitted member 242. For convenience, illustrations of components which are arranged outside of the driving gear 225 are omitted in FIG. 19 and in Figs thereafter regarding sections of the driving gear and the retainer.

As shown in FIG. 15, each ball 143 is held by a ball holding groove **242*a* formed on the transmitted member 242 and the ball holding groove 156 formed on the spindle 150. Accordingly, the transmitted member 242 and the spindle 150 are configured to rotate integrally via the balls 143**.

As shown in FIG. 15 and FIG. 16, the coil spring 145 is provided coaxially with the spindle 150 around the rotation transmitting shaft 155 so as to extend in the longitudinal direction of the spindle 150. One end of the coil spring 145 penetrates the driving gear 225 and contacts with the retainer 230, and the other end is in contact with the spindle 150, and thereby the spindle 150 is biased toward a front region to which the tool bit 119 is attached (toward front side of the screwdriver 200). The spindle 150 is prevented from moving forward of the screw driver 200 by contact of the ball holding groove 156 and the ball 143 and contact of the retainer 230 and the ball 143. Further, the retainer 230 is prevented from moving forward by the stopper 229 via the driving gear 225. On the other hand, the retainer 230 is biased toward a rear region opposite to the front region (toward rear side of the screwdriver 200) by the coil spring 145. At this time, the retainer 230 is prevented from moving rearward of the screw driver 200 by the needle bearing 137.

(Screw Operation)

Figure 20:
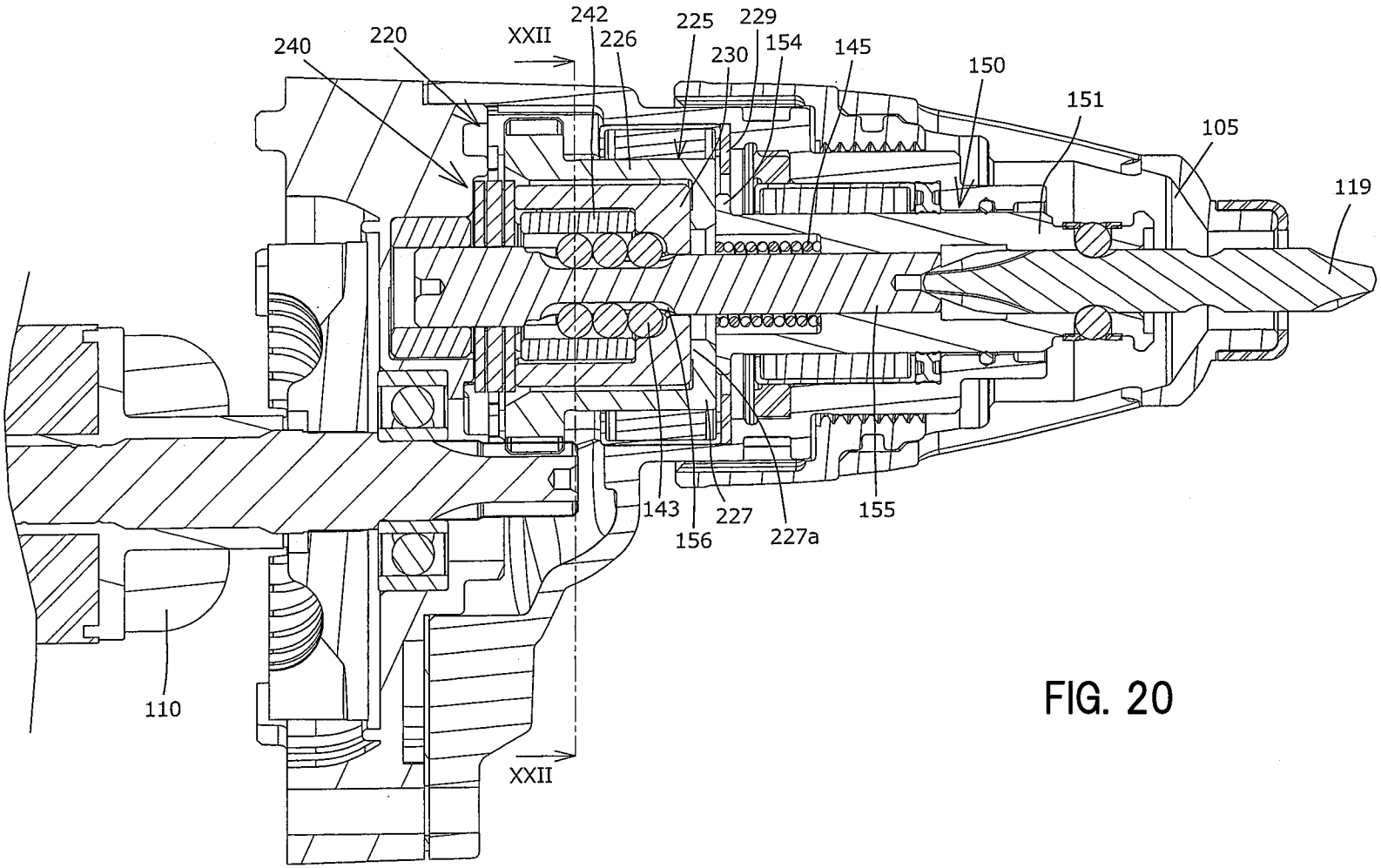
FIG. 20 shows a cross sectional view which corresponds to FIG. 15 in a state of a screw operation.
Figure 21:
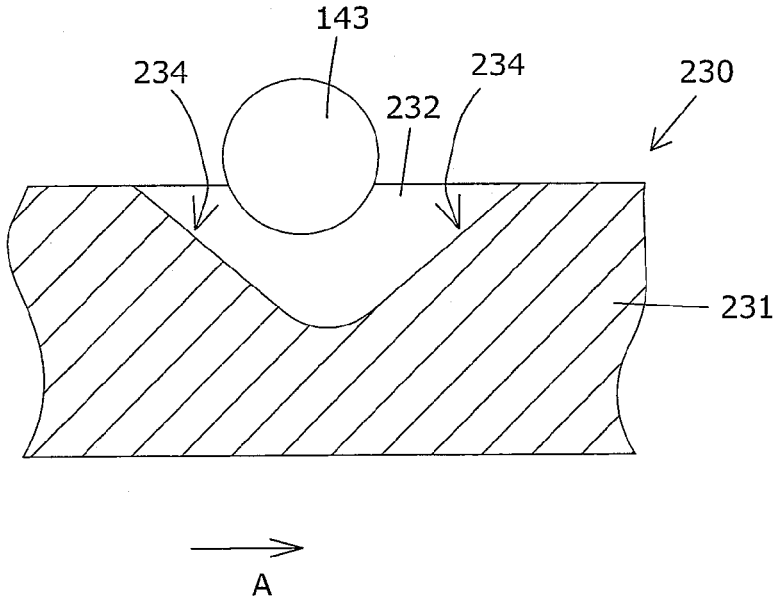
FIG. 21 shows a cross sectional view which corresponds to FIG. 18 in a state of the screw operation.
Figure 22:
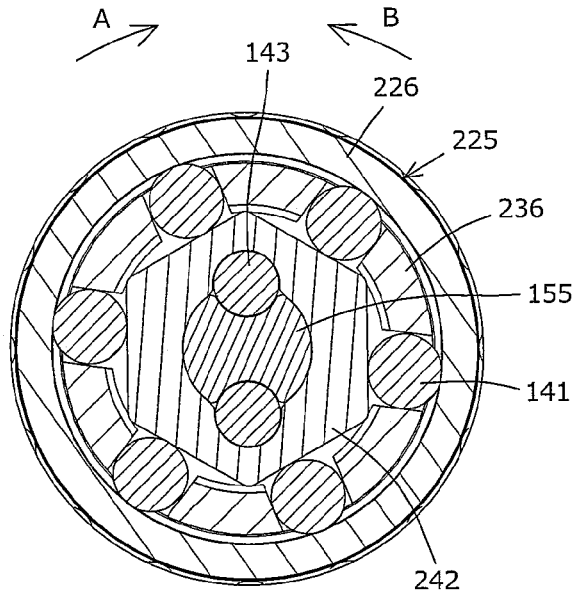
FIG. 22 shows a cross sectional view taken along the XXII-XXII line in FIG. 20.

As shown in FIG. 20, when the tool bit 119 is pushed via a screw (now shown) against a workpiece, the spindle 150 is moved rearward of the screw driver 200 against the biasing force of the coil spring 145. At this time, the balls 143 are moved rearward with movement of the spindle 150. Thus, as shown in FIG. 21 and FIG. 22, contact between the ball 143 and the incline portion 234 is released (canceled), and the bottom wall 227 of the driving gear 225 which is pushed by the flange portion 154 of the spindle 150 rotates the retainer 230 via the contact portion **227*a*. That is, by friction force between the contact portion 227*a* and the retainer 230, the retainer 230** is rotated in a direction indicated by an arrow A (A-direction).

The roller 141 is moved by rotation of the retainer 230, and thereby the roller 141 is clamped between the driving gear 225 and the transmitted member 242. As a result, the driving gear 225 and the transmitted member 242 are integrally rotated in the A-direction by a wedge effect of the roller 141. Thus, the tool bit 119 held by the spindle 150 is rotationally driven and performs the screw operation.

By screwing a screw into the workpiece in a state that the locator 105 contacts with the workpiece, the spindle 150 is moved forward of the screw driver 200. Similar to the first embodiment, the ball 143 pushes the incline portion 234. Thus, the retainer 230 is rotated in the B-direction with respect to the driving gear 225 rotating in the A-direction. As a result, the retainer 230 and the roller 141 are moved into a position indicated in FIG. 19, and thereby transmission of rotation of the driving gear 225 to the transmitted member 242 is interrupted. Accordingly, the screw is screwed in a predetermined depth to the workpiece and the screw operation is finished. The incline portion 234 of the groove 232 is one example which corresponds to "a guide portion" of the present invention.

(Unscrew Operation)

In the second embodiment, similar to the screw operation, the spindle 150 is pushed against a workpiece via tool bit 119, and thereby the tool bit 119 (spindle 150) is driven. In the unscrew operation, the driving gear 225 is rotated in the B-direction.

Third Embodiment

Next, a third embodiment of the present invention is explained with reference to FIG. 23 to FIG. 31. In a screw driver 300, the same components described in the first embodiment are assigned the same symbols as in the first embodiment and explanations thereof are therefore omitted.

As shown in FIG. 23 to FIG. 27, a driving mechanism 320 is mainly provided with a driving gear 325, a retainer 330, a transmitting mechanism 340, the coil spring 145 and the spindle 150. The driving mechanism 320 is one example which corresponds to "a rotation transmitting mechanism" of the present invention.

Figure 23:
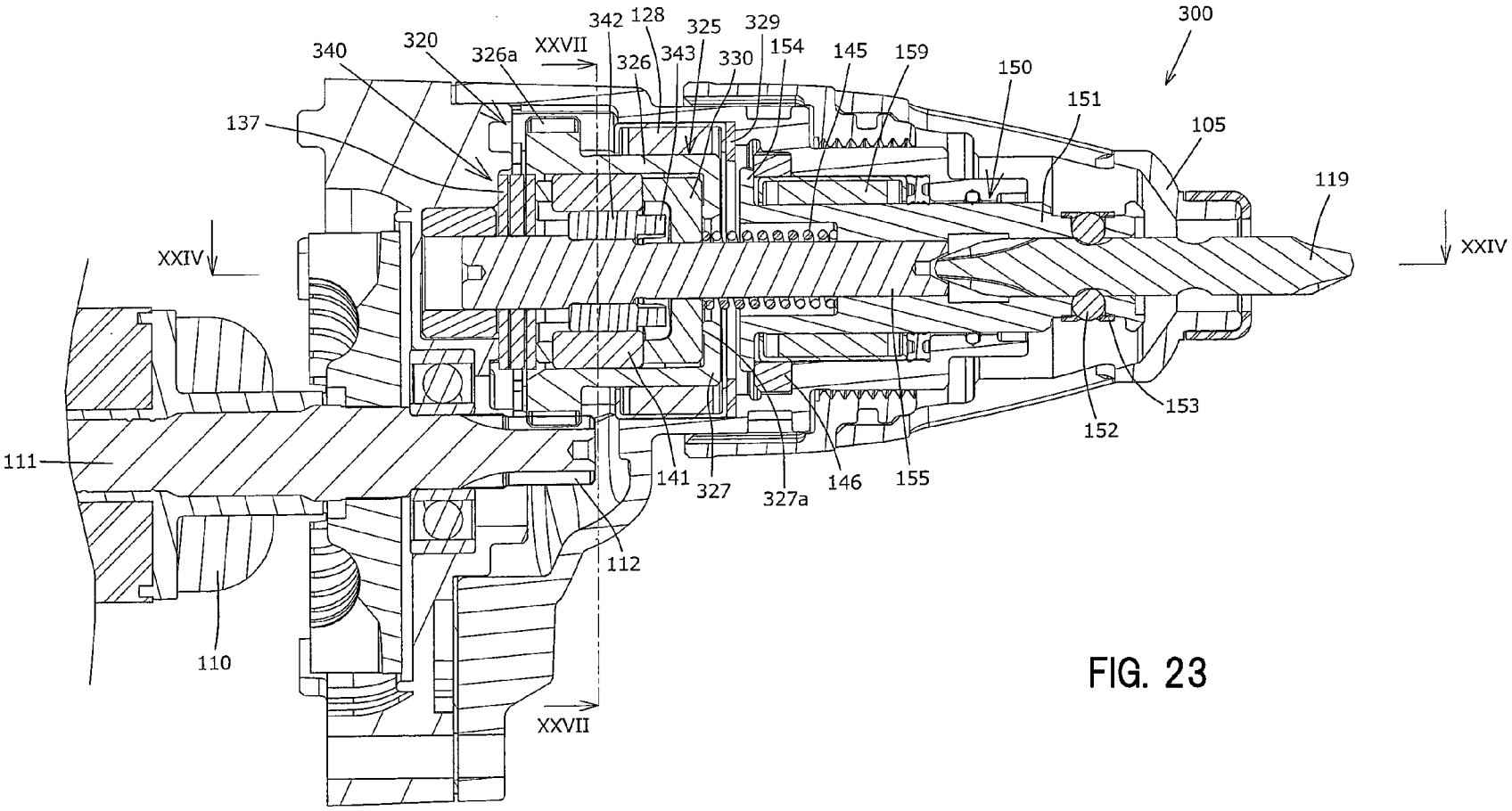
FIG. 23 shows a cross sectional view of a screw driver of a third embodiment of the present invention.
Figure 24:
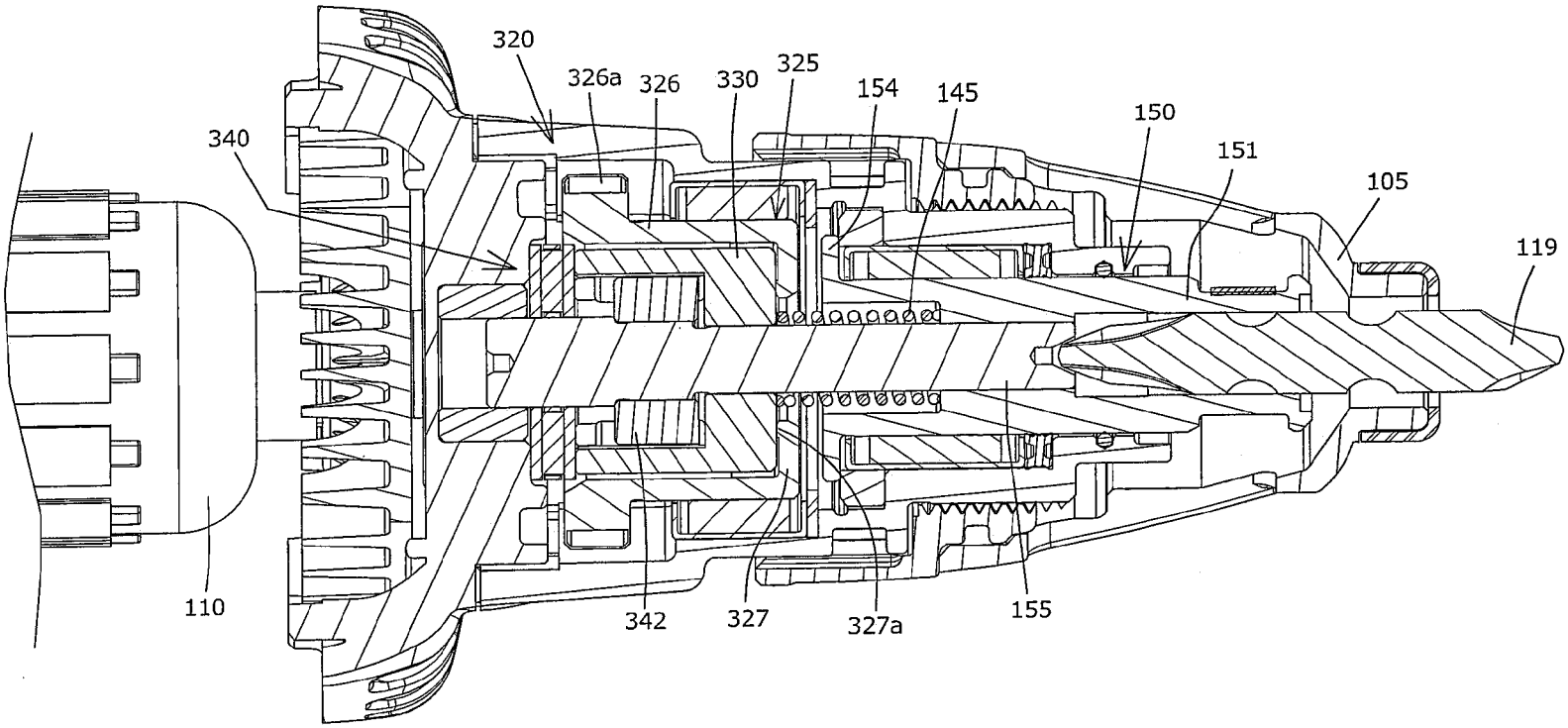
FIG. 24 shows a cross sectional view taken along the XXIV-XXIV line in FIG. 23.

As shown in FIG. 23 and FIG. 24, the driving gear 325 is a substantially cup-shaped member which has a side wall 326 and a bottom wall 327. Inside region of the side wall 326 is formed cylindrically and thereby the driving gear 325 houses the retainer 330 and the transmitting mechanism 340 therein. Gear teeth 326*a* is formed on the side wall 326. The gear teeth 326*a* mesh with gear teeth 112 which are formed on the output shaft 111 of the motor 110. A through-hole through which the spindle 150 penetrates is provided on a center region of the bottom wall 327. A contact portion 327*a* which is contactable with the retainer 330 is defined around the through-hole. Accordingly, the driving gear 325 and the retainer 330 contact with each other via the contact portion 327*a*, that is, other part of the driving gear 325 does not contact with the retainer 330. The driving gear 325 is disposed such that it moves in a longitudinal direction of the spindle 150 (axial direction of the tool bit 119). Further, a stopper 229 is provided in front of the driving gear 325 and thereby forward movement of the driving gear 325 in the screw driver 300 is prevented by the stopper 329. The driving gear 325 is one example which corresponds to "a driving member" of the present invention.

Figure 25:
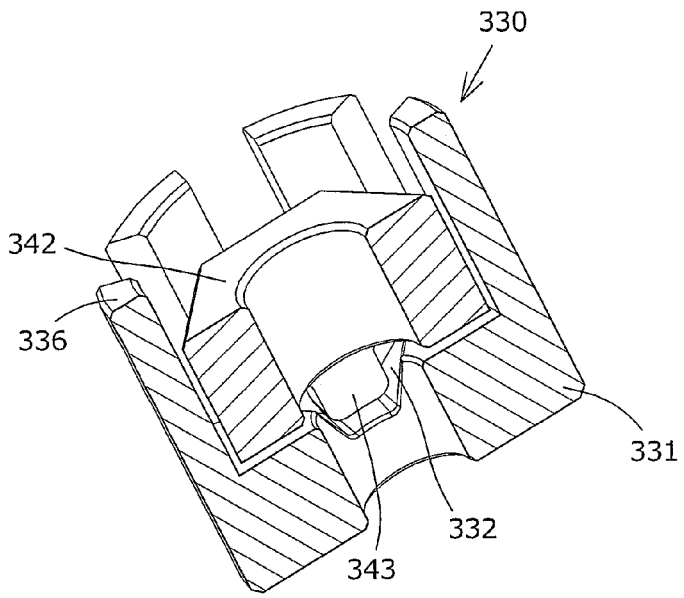
FIG. 25 shows a perspective cross sectional view of a retainer and a transmitted member.

As shown in FIG. 25, the retainer 330 is substantially cylindrical member which comprises a base portion 331 and a side portion 336. The base portion 331 faces the bottom wall 327 of the driving gear 325 and the side portion 336 faces the side wall 326 of the driving gear 325. Further, components other than the retainer 330 and the transmitted member 342 are not shown in FIG. 25.

Figure 26:
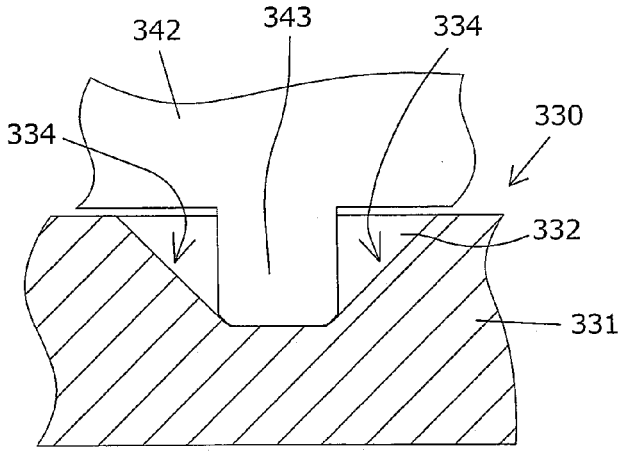
FIG. 26 shows a cross sectional view of a groove of the retainer.

As shown in FIG. 25, two grooves 332 are formed on the base portion 331 along a circumference direction of the retainer 330. As shown in FIG. 26, each groove 332 is formed by two incline portions 334 which incline with respect to the base portion 331. The side portion 336 is, similar to the first embodiment, provided so as to protrude from the base portion 331 in an axial direction of the cylindrical retainer 330. The retainer 330 is one example which corresponds to "a switching member" of the present invention.

Figure 27:
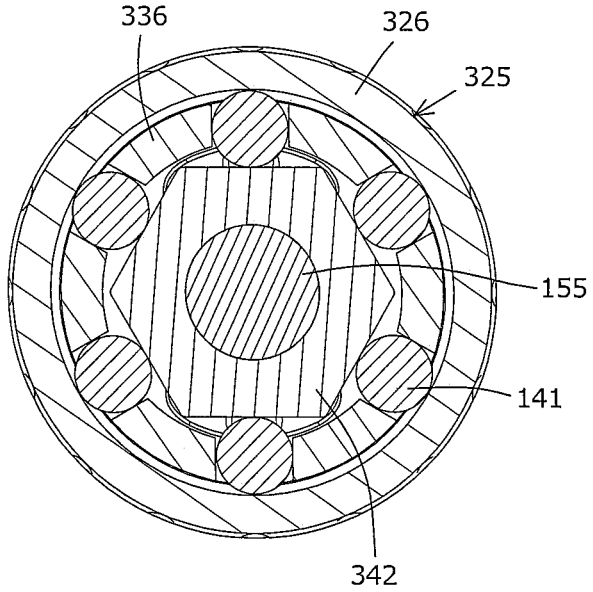
FIG. 27 shows a cross sectional view taken along the XXVII-XXVII line in FIG. 23.

As shown in FIG. 23 and FIG. 24, the transmitting mechanism 340 is mainly provided with rollers 141 and a transmitted member 342. As shown in FIG. 27, the transmitted member 342 has a substantially hexagonal shape section. Similar to the first embodiment, six rollers 141 are disposed on the outer surface of the transmitted member 342 such that each roller 142 corresponds to each side of the hexagon of the transmitted member 342.

As shown in FIG. 23 and FIG. 25, the transmitted member 342 has two protrusion 343 which correspond to two grooves 332 of the retainer 330, respectively. The rotation transmitting shaft 155 is fitted into the transmitted member 342 and thereby the spindle 150 and the transmitted member 342 are configured to rotate integrally. The protrusion 343 is one example which corresponds to "an axially movable element" of the present invention.

As shown in FIG. 23 and FIG. 24, the coil spring 145 is provided coaxially with the spindle 150 around the rotation transmitting shaft 155 so as to extend in the longitudinal direction of the spindle 150. One end of the coil spring 145 penetrates the driving gear 325 and contacts with the retainer 330, and the other end is in contact with the spindle 150, and thereby the spindle 150 is biased toward a front region to which the tool bit 119 is attached (toward front side of the screwdriver 300). The stopper 146 is provided in front of the flange portion 154. Thus, the spindle 150 is prevented from moving forward of the screw driver 300 by contact of the flange portion 154 and the stopper 146. Further, the retainer 330 is biased toward a rear region opposite to the front region (toward rear side of the screw driver 200) by the coil spring 145. At this time, the retainer 330 is prevented from moving rearward of the screw driver 300 by the needle bearing 137.

(Screw Operation)

Figure 28:
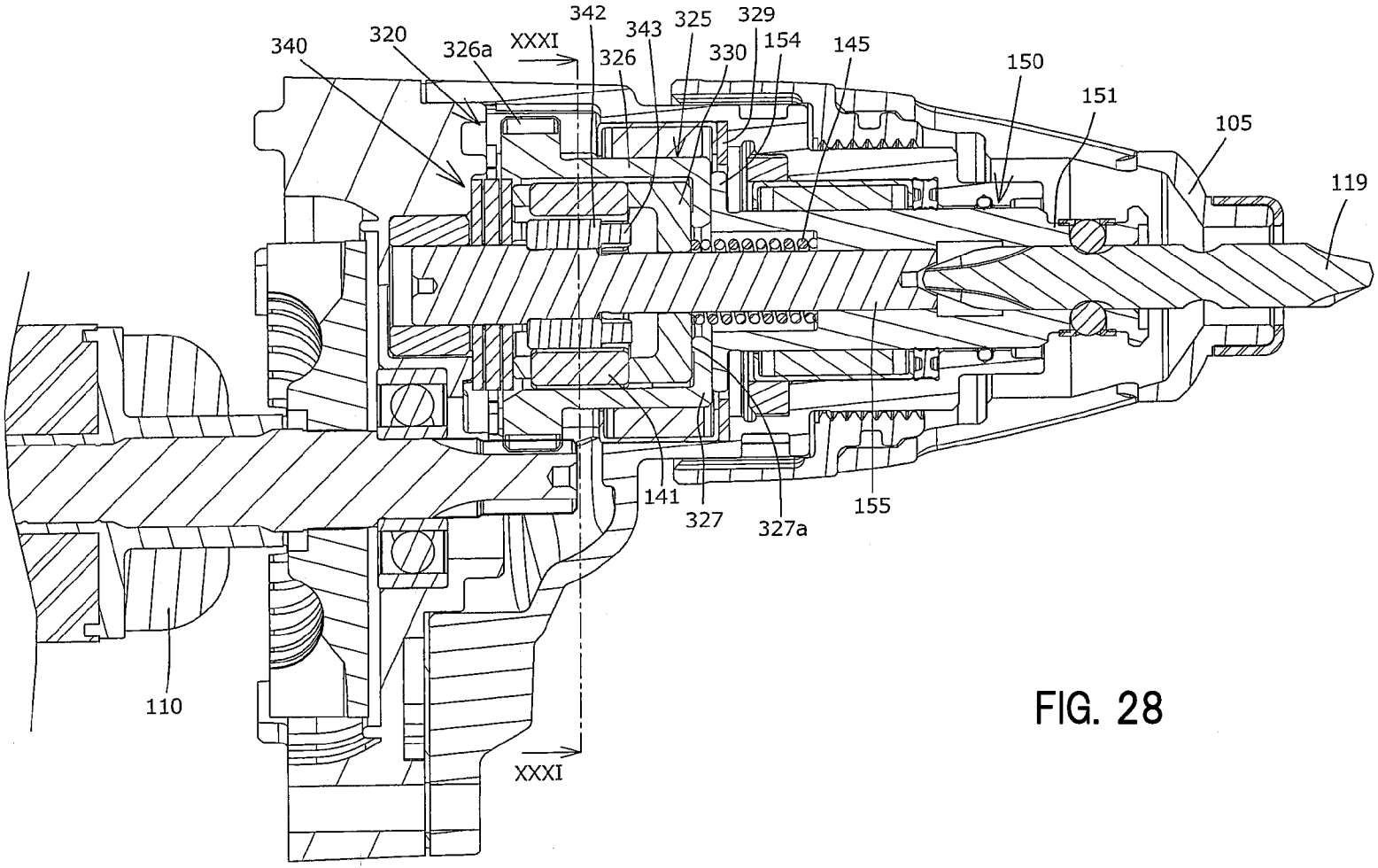
FIG. 28 shows a cross sectional view which corresponds to FIG. 23 in a state of a screw operation.
Figure 29:
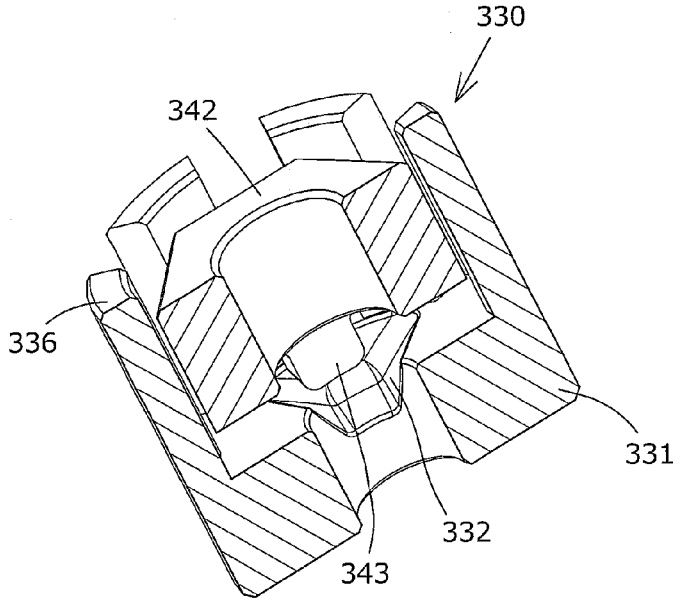
FIG. 29 shows a perspective cross sectional view which corresponds to FIG. 25 in a state of the screw operation.
Figure 30:
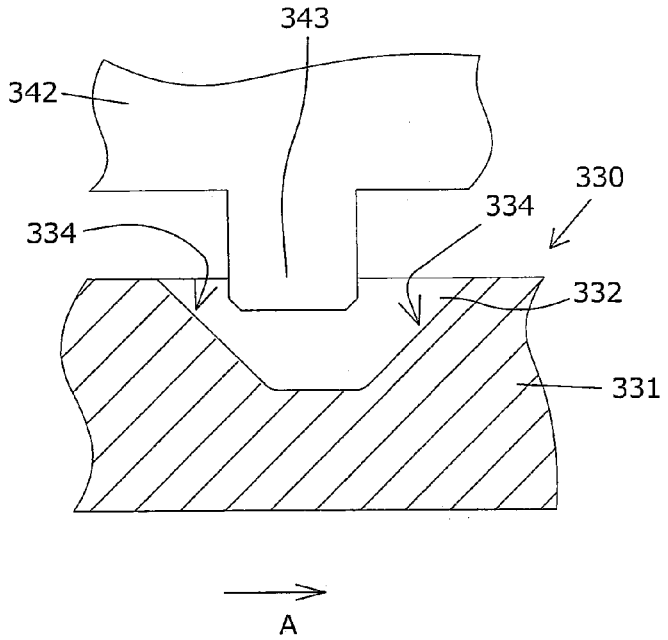
FIG. 30 shows a cross sectional view which corresponds to FIG. 26 in a state of the screw operation.
Figure 31:
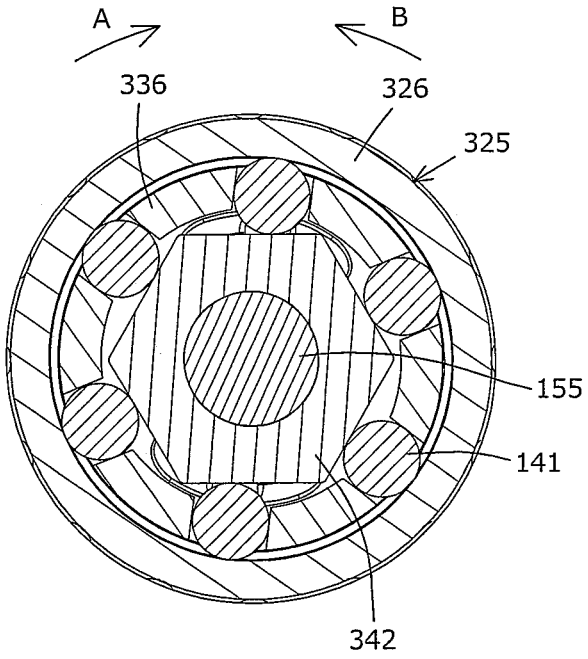
FIG. 31 shows a cross sectional view taken along the XXXI-XXXI line in FIG. 28.

As shown in FIG. 28, when the tool bit 119 is pushed via a screw (now shown) against a workpiece, the spindle 150 is moved rearward of the screw driver 300 against the biasing force of the coil spring 145. At this time, the transmitted member 342 is moved rearward together with the spindle 150. Thus, as shown in FIG. 29 to FIG. 30, contact between the protrusion 343 and the incline portion 334 is released (canceled), and the bottom wall 327 of the driving gear 325 which is pushed by the flange portion 154 of the spindle 150 rotates the retainer 330 via the contact portion 327*a*. That is, by friction force between the contact portion 327*a* and the retainer 330, the retainer 330 is rotated in a direction indicated by an arrow A (A-direction).

The roller 141 is moved by rotation of the retainer 330, and thereby the roller 141 is clamped between the driving gear 325 and the transmitted member 342. As a result, the driving gear 325 and the transmitted member 342 are integrally rotated in the A-direction by a wedge effect of the roller 141. Thus, the tool bit 119 held by the spindle 150 is rotationally driven and performs the screw operation.

By screwing a screw into the workpiece in a state that the locator 105 contacts with the workpiece, the spindle 150 is moved forward of the screw driver 300 and thereby the protrusion 343 pushes the incline portion 334. Accordingly, the retainer 330 rotates relatively in the B-direction with respect to the driving gear 325 rotating in the A-direction. As a result, the retainer 330 and the roller 141 are moved into a position indicated in FIG. 27, and thereby transmission of rotation of the driving gear 325 to the transmitted member 342 is interrupted. Accordingly, the screw is screwed in a predetermined depth to the workpiece and the screw operation is finished. The protrusion 343 and the incline portion 334 of the groove 332 are examples which correspond to "a contact portion" and "a guide portion" of the present invention, respectively.

(Unscrew Operation)

In the third embodiment, similar to the screw operation, the spindle 150 is pushed against a workpiece via tool bit 119, and thereby the tool bit 119 (spindle 150) is driven. In the unscrew operation, the driving gear 325 is rotated in the B-direction.

Fourth Embodiment

Next, a fourth embodiment of the present invention is explained with reference to FIG. 32 to FIG. 43. In a screw driver 400, the same components described in the first embodiment are assigned the same symbols as in the first embodiment and explanations thereof are therefore omitted.

As shown in FIG. 32 to FIG. 38, a driving mechanism 420 is mainly provided with a driving gear 425, a retainer 430, a transmitting mechanism 440, the coil spring 145 and the spindle 150. The driving mechanism 420 is one example which corresponds to "a rotation transmitting mechanism" of the present invention.

Figure 32:
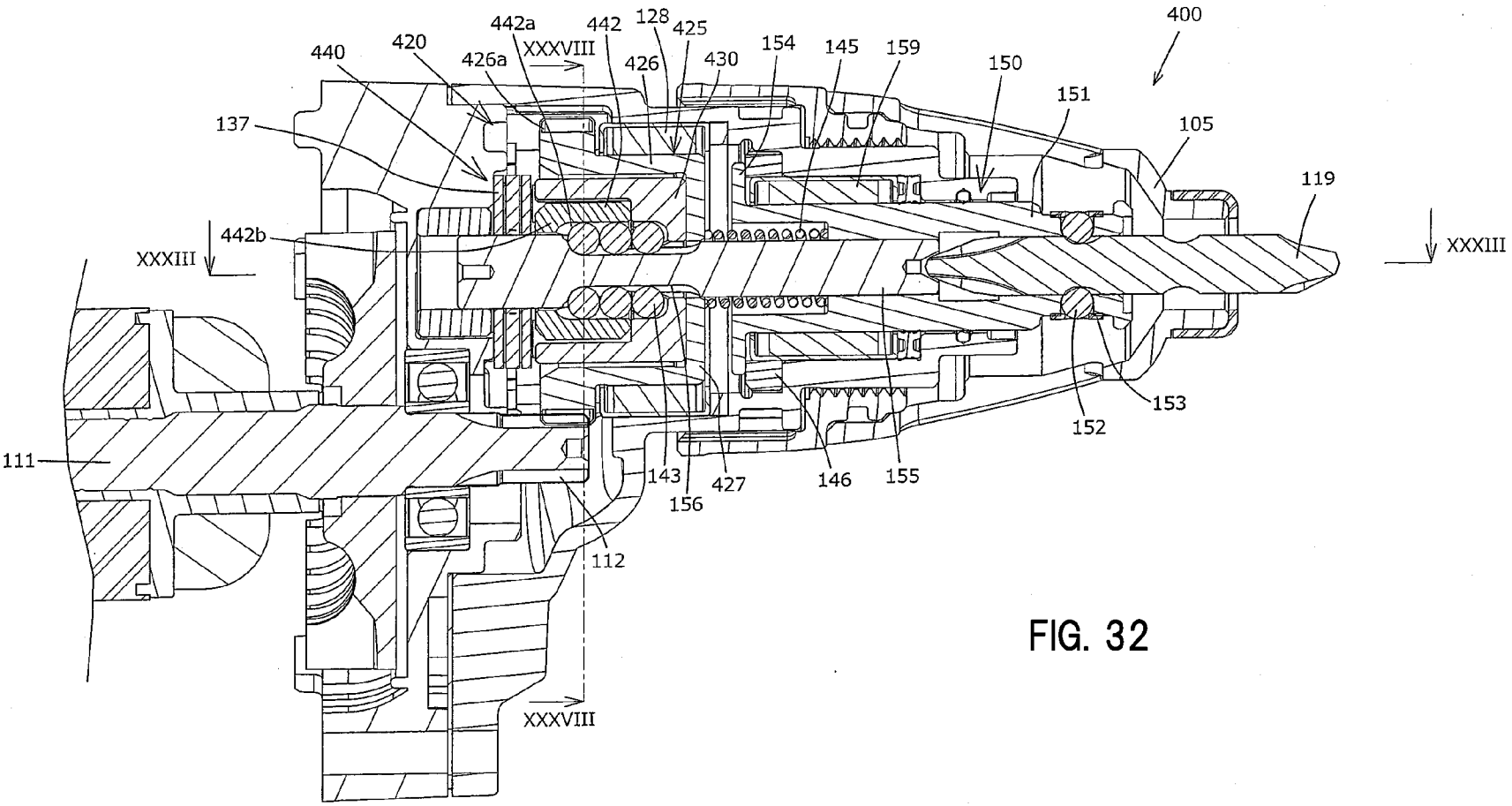
FIG. 32 shows a cross sectional view of a screw driver of a fourth embodiment of the present invention.
Figure 33:
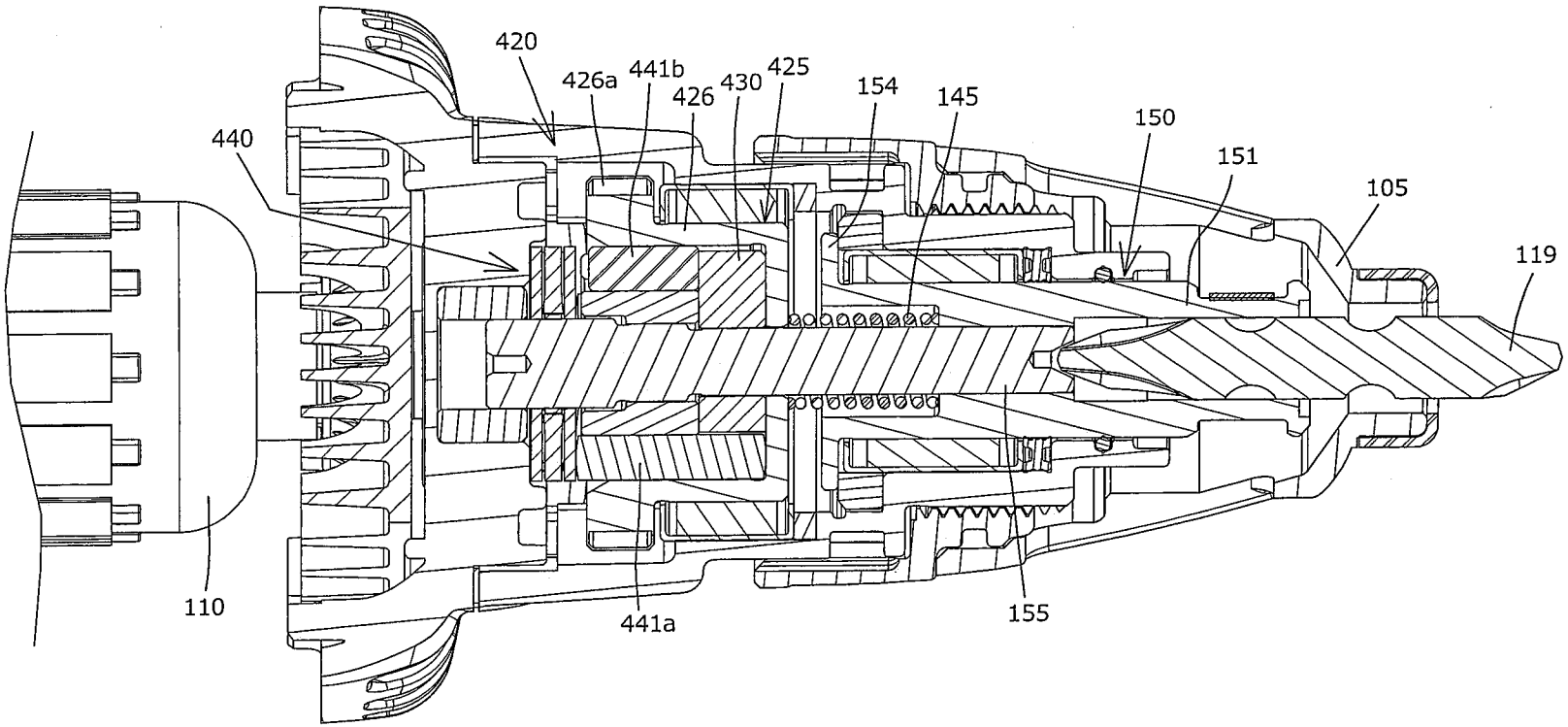
FIG. 33 shows a cross sectional view taken along the XXXIII-XXXIII line in FIG. 32.

As shown in FIG. 32 and FIG. 33, the driving gear 425 is a substantially cup-shaped member which has a side wall 426 and a bottom wall 427. Inside region of the side wall 426 is formed cylindrically and thereby the driving gear 425 houses the retainer 430 and the transmitting mechanism 440 therein. Gear teeth 426*a* is formed on the side wall 426. The gear teeth 426*a* mesh with gear teeth 112 which are formed on the output shaft 111 of the motor 110. A through-hole through which the spindle 150 penetrates is provided on a center region of the bottom wall 427. A contact portion 427*a* which is contactable with the retainer 430 is defined around the through-hole. Accordingly, the driving gear 425 and the retainer 430 contact with each other via the contact portion 427*a*, that is, other part of the driving gear 425 does not contact with the retainer 430. The driving gear 425 is disposed such that it moves in a longitudinal direction of the spindle 150 (axial direction of the tool bit 119). The driving gear 425 is one example which corresponds to "a driving member" of the present invention.

Figure 34:
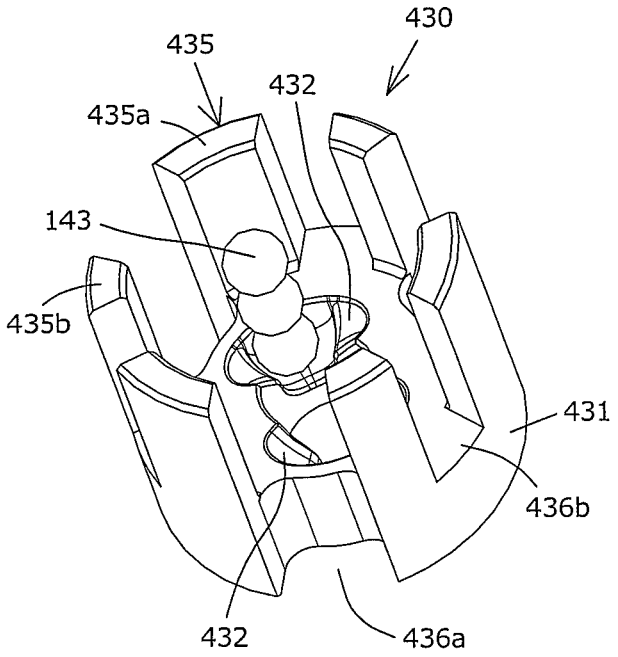
FIG. 34 shows a perspective view of a retainer and balls.

As shown in FIG. 34, the retainer 430 is substantially cylindrical member which comprises a base portion 431 and a side portion 435. The base portion 431 faces the bottom wall 427 of the driving gear 425 and the side portion 435 faces the side wall 426 of the driving gear 425. Further, components other than the retainer 430 and the balls 143 are not shown in FIG. 34. The retainer 430 is one example which corresponds to "a switching member" of the present invention.

Figure 35:
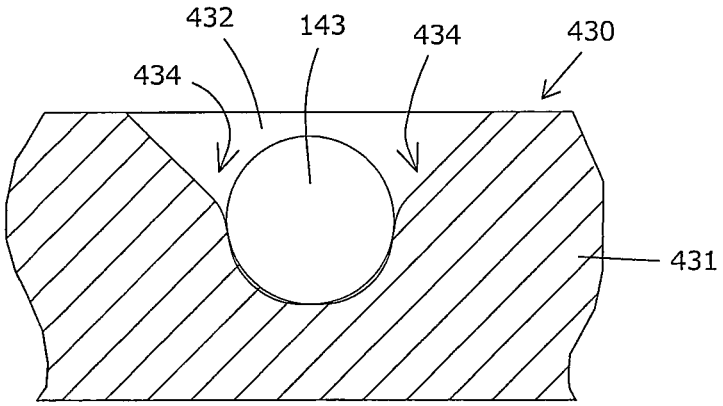
FIG. 35 shows a cross sectional view of a groove of the retainer.

As shown in FIG. 34, two grooves 432 are formed on the base portion 431 along a circumference direction of the retainer 430. As shown in FIG. 35, each groove 432 is formed by two incline portions 434 which incline with respect to the base portion 431.

Figure 36:
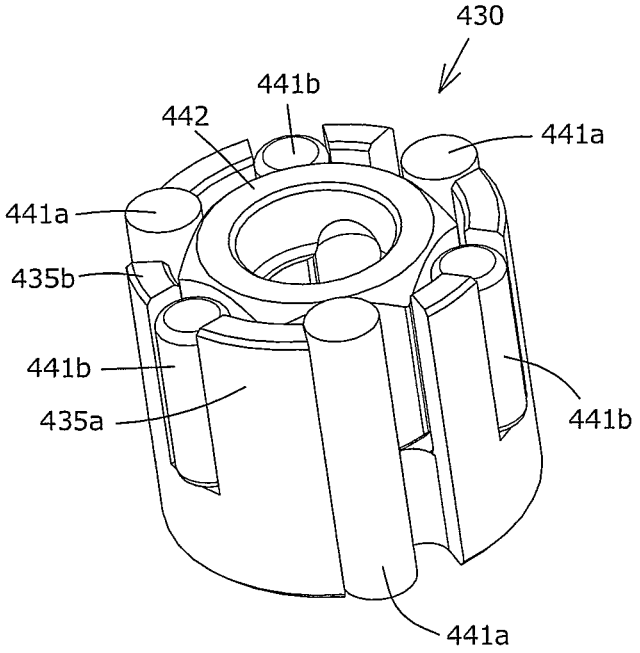
FIG. 36 shows a perspective view of the retainer, rollers and a transmitted member.

As shown in FIG. 34 and FIG. 36, the side portion 436 is provided so as to protrude from the base portion 431 in an axial direction of the cylindrical retainer 430. The side portion 436 has three wide portions 435*a* and three narrow portions 435*b*. The wide portion 435*a* and the narrow portion 436*b* are arranged one after the other in the circumference direction of the retainer 430. The wide portion 435*a* is provided such that its length is longer than a length of the narrow portion 435*b* in the circumference direction.

A first roller holding portion 436*a* and a second roller holding portion 436*b* are defined by space between the wide portion 435*a* and the narrow portion 435*b* in the circumference direction of the retainer 430. The first roller holding portion 436*a* and the second roller holding portion 436*b* are arranged one after the other in the circumference direction of the retainer 430. The first roller holding portion 436*a* is defined such that its length is longer than a length of the second roller holding portion 436*b* in the circumference direction. The first roller holding portion 436*a* is formed so as to penetrate the base portion 431 in the axial direction of the retainer 430, in other words, the first roller holding portion 436*a* is formed from one end another in the axial direction of the retainer 430.

Figure 37:
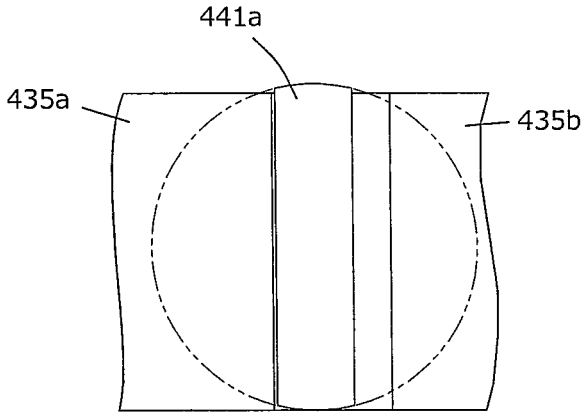
FIG. 37 shows a side view of the retainer and the roller.

As shown in FIG. 36, a first roller 441*a* is provided in the first roller holding portion 436*a*, and a second roller 441*b* is provided in the second roller holding portion 436*b*. The first roller 441*a* is formed such that its axial length is longer than the second roller 441*b*. As shown in FIG. 37, the first roller 441*a* has circular arc shape at its both ends. The both ends are formed as a circular arc of which diameter is equal to the axial length of the first roller 441*a*. The first roller 441*a* and the second roller 441*b* are one example which corresponds to "a transmitting member" of the present invention.

Figure 38:
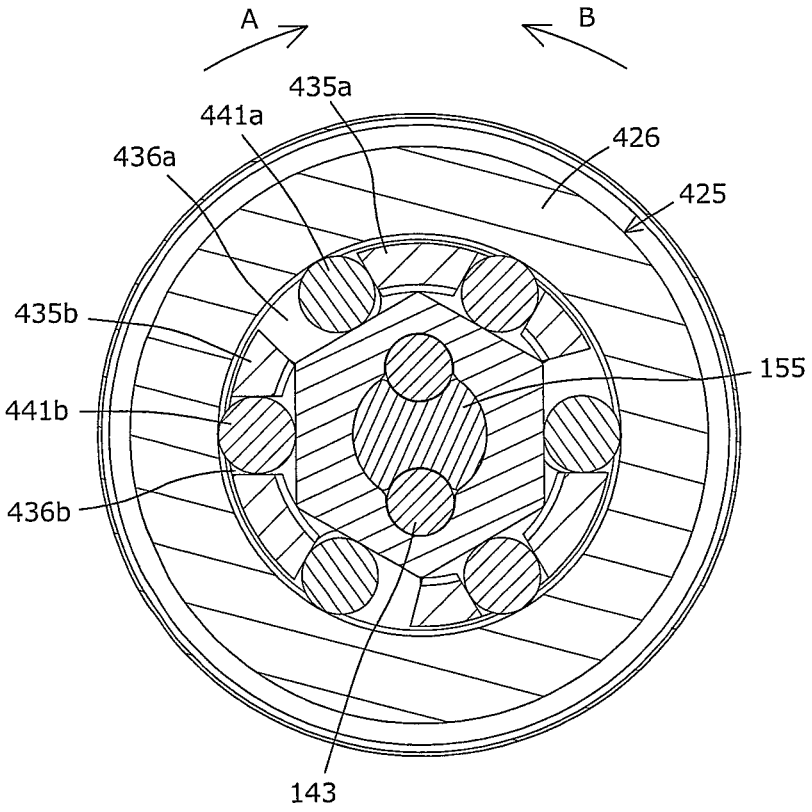
FIG. 38 shows a cross sectional view taken along the XXXVIII-XXXVIII line in FIG. 32.

As shown in FIG. 32 and FIG. 33, the transmitting mechanism 440 is mainly provided with the first roller 441*a*, the second roller 441*b*, a transmitted member 442 and the balls 143. As shown in FIG. 38, the transmitted member 442 has a hexagonal section.

As shown in FIG. 32, each ball 143 is held by a ball holding groove 442*a* formed on the transmitted member 442 and the ball holding groove 156 formed on the spindle 150. Accordingly, the transmitted member 442 and the spindle 150 are configured to rotate integrally via the balls 143.

As shown in FIG. 32 and FIG. 33, the coil spring 145 is provided coaxially with the spindle 150 around the rotation transmitting shaft 155 so as to extend in the longitudinal direction of the spindle 150. One end of the coil spring 145 contacts with the driving gear 425, and the other end contacts with the spindle 150, and thereby the spindle 150 is biased toward a front region to which the tool bit 119 is attached (toward front side of the screw driver 400). The stopper 146 is provided in front of the flange portion 154. Thus, the spindle 150 is prevented from moving forward of the screw driver 400 by contact of the flange portion 154 and the stopper 146. On the other hand, the driving gear 425 is biased toward a rear region opposite to the front region (toward rear side of the screw driver 400) by the coil spring 145. At this time, the driving gear 425 is prevented from moving rearward of the screw driver 400 by the retainer 430 and the needle bearing 137.

As shown in FIG. 38, in a state that rotation of the driving gear 425 is not transmitted to the transmitted member 442, the first roller 441*a* and the second roller 441*b* are positioned in each center region which corresponds to center of each side of the hexagonal section of the transmitted member 442.

At this time, the second roller holding portion 436*b* is positioned so as to face the center region. On the other hand, the first roller holding portion 436*a* is positioned so as to face a back region (rear region) with respect to the center region in a rotational direction (A-direction) during the screw operation.

(Screw Operation)

Figure 39:
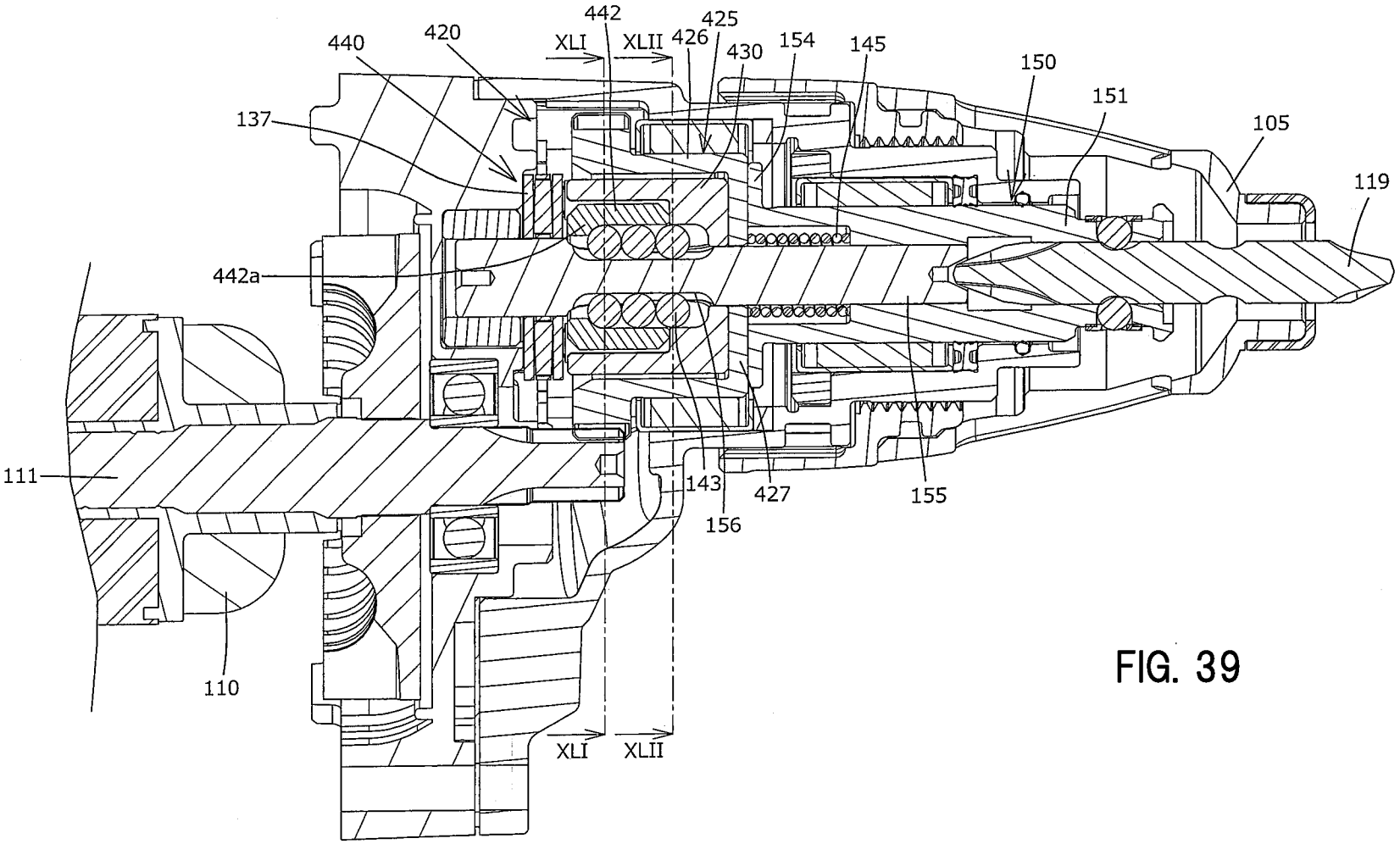
FIG. 39 shows a cross sectional view which corresponds to FIG. 32 in a state of a screw operation.
Figure 40:
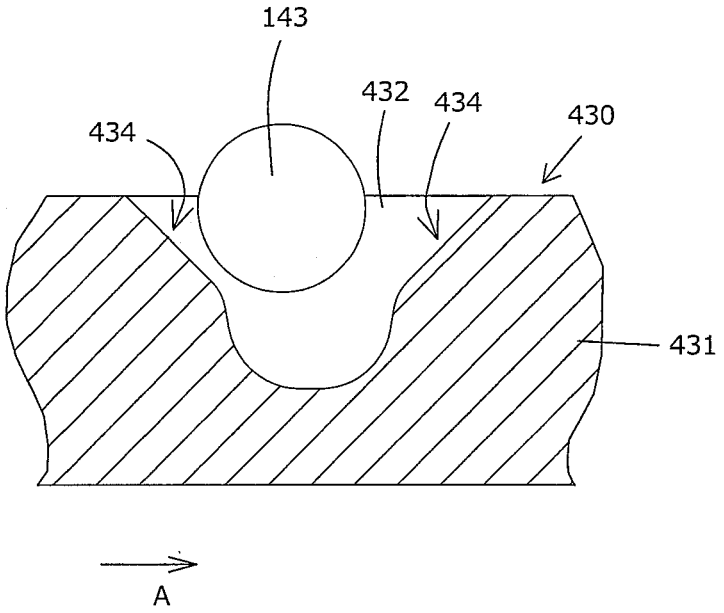
FIG. 40 shows a cross sectional view which corresponds to FIG. 35 in a state of the screw operation.
Figure 41:
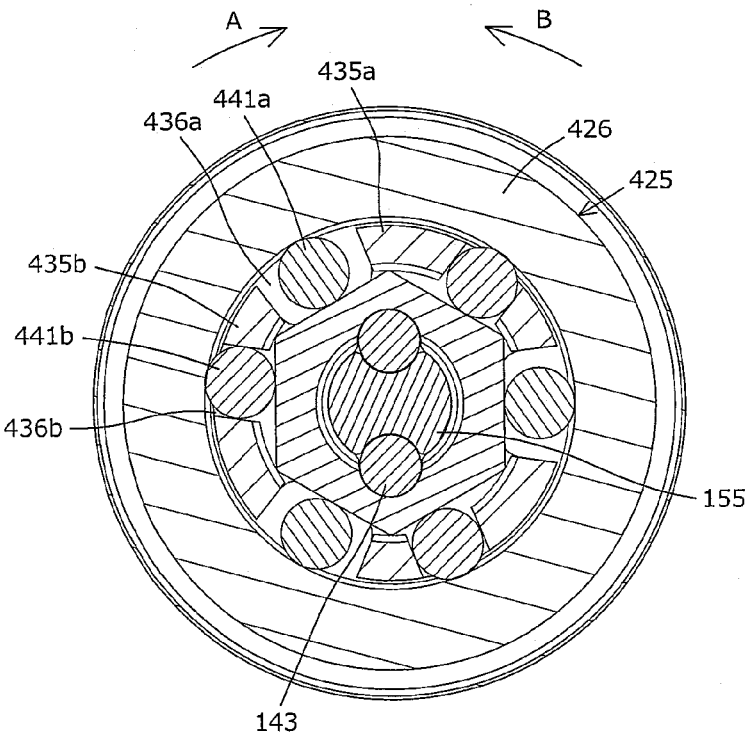
FIG. 41 shows a cross sectional view taken along the XLI-XLI line in FIG. 39.
Figure 42:
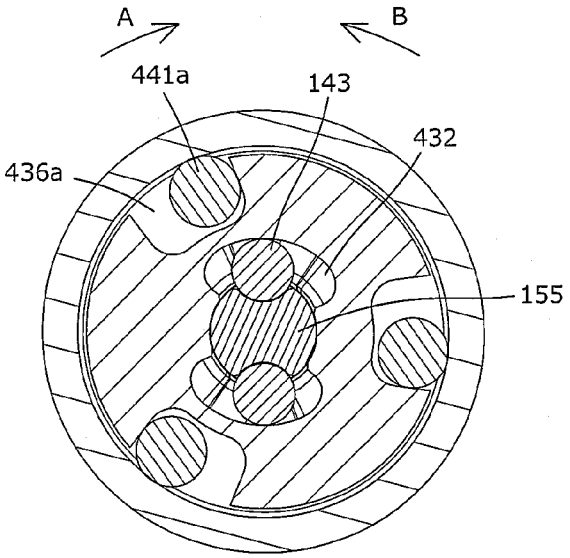
FIG. 42 shows a cross sectional view taken along the XLII-XLII line in FIG. 39.
Figure 43:
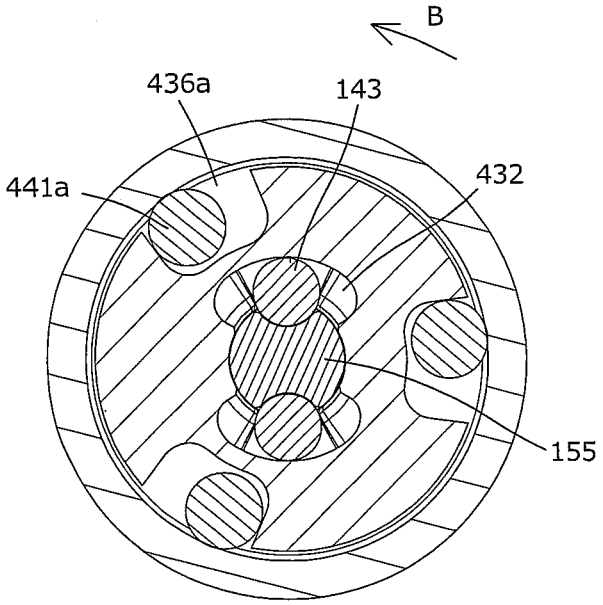
FIG. 43 shows a cross sectional view which corresponds to FIG. 42 in a state of an unscrew operation.

As shown in FIG. 39, when the tool bit 119 is pushed via a screw (now shown) against a workpiece, the spindle 150 is moved rearward of the screw driver 400 against the biasing force of the coil spring 145. At this time, the balls 143 are moved rearward with movement of the spindle 150. Thus, as shown in FIG. 40 to FIG. 42, contact between the ball 143 and the incline portion 434 is released (canceled), and the bottom wall 427 of the driving gear 425 which is pushed by the flange portion 154 of the spindle 150 rotates the retainer 430. That is, by friction force between the bottom wall 427 and the retainer 430, the retainer 430 is rotated in a direction indicated by an arrow A (A-direction).

The second roller 441*b* is moved by rotation of the retainer 430, and thereby the second roller 441*b* is clamped between the driving gear 425 and the transmitted member 442. As a result, the driving gear 425 and the transmitted member 442 are integrally rotated in the A-direction by a wedge effect of the second roller 441*b*. Thus, the tool bit 119 held by the spindle 150 is rotationally driven and performs the screw operation.

By screwing a screw into the workpiece in a state that the locator 105 contacts with the workpiece, the spindle 150 is moved forward of the screw driver 400. Similar to the first embodiment, the ball 143 pushes the incline portion 434. Thus, the retainer 430 is rotated in the B-direction with respect to the driving gear 425 rotating in the A-direction. As a result, the retainer 430 and the second roller 441*b* are moved into a position indicated in FIG. 38, and thereby transmission of rotation of the driving gear 425 to the transmitted member 442 is interrupted. Accordingly, the screw is screwed in a predetermined depth to the workpiece and the screw operation is finished. The second roller 441*b* is one example which corresponds to "a transmitting element belonging to a first group" of the invention, Further, the incline portion 434 of the groove 432 is one example which corresponds to "a guide portion" of the present invention.

(Unscrew Operation)

In the fourth embodiment, similar to the first embodiment, the tool bit 119 is driven by the motor 111 in a state that the tool bit 119 is not pushed against a screw (workpiece) during the unscrew operation.

Figure 44:
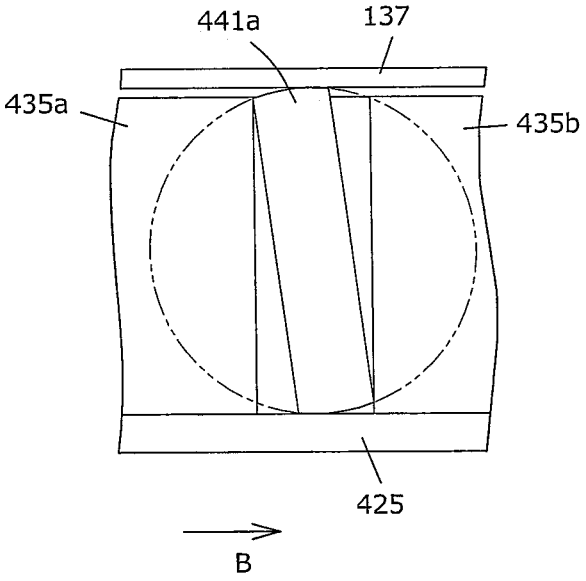
FIG. 44 shows a cross sectional view which corresponds to FIG. 37 in a state of the unscrew operation.

Specifically, in a state indicated in FIG. 38, when the output shaft 111 of the motor 110 is rotated in an opposite direction, the driving gear 425 side end of the first roller 441*a* which is clamped by the driving gear 425 and the needle bearing 137 due to biasing force of the coil spring 145 is moved as shown in FIG. 44. Accordingly, as shown in FIG. 44, the first roller 441*a* is inclined within the first roller holding portion 436*a* and thereby the driving gear 425 side of the first roller 441*a* is clamped by the driving gear 425 and the transmitted member 442. As a result, the driving gear 425 and the transmitted member 442 are rotated integrally in the B-direction due to the wedge effect of the first roller 441*a*. Accordingly, the tool bit 119 is rotationally driven without pushing the tool bit 119 against the screw (workpiece). Further, the first roller 441*a* is not limited to be inclined within the first roller holding portion 436*a* as shown in FIG. 44. The first roller 441*a* may be moved in the rotation direction of the driving gear 425 and be positioned in parallel with the axial direction of the tool bit 119. by moving the needle bearing 137 side of the first roller 441*a* is moved before the driving gear 425 side portion of the first roller 441*a* is clamped. The first roller 441*a* is one example which corresponds to "a transmitting element belonging to a second group" of the present invention.

According to the first to the fourth embodiments described above, the rollers 141, 441 are switched in positions between a rotation transmittable position and a rotation non-transmittable position, by rotation of the retainer 130, 230, 330, 440 in a circumference direction of the spindle 150. That is, the position of the rollers 141, 441 is rationally switched by rotation of the driving gear 125, 225, 325, 425.

Further, according to the first to the fourth embodiments, by utilizing the roller 141, 441, the wedge effect of the roller 141, 441 which is clamped between the driving gear 125, 225, 325, 425 and the transmitted member 142, 242, 342, 442 is easily obtained. Thus, rotation of the output shaft 111 of the motor 110 is transmitted to the spindle 150 by means of the wedge effect.

Further, according to the first, the second and the fourth embodiments, in the screw operation, the ball 143 contacts with the incline portion 134, 234, 434 of the groove 132, 232, 432 formed on the retainer 130, 230, 430 with screwing of a screw and thereby rotation transmission from the driving gear 125, 225, 425 to the transmitted member 142, 242, 442 is interrupted. Thus, the screw operation is finished precisely in a predetermined depth of the screwing.

Further, according to the third embodiment, in the screw operation, the protrusion 343 of the transmitted member 342 contacts with the incline portion 334 of the groove 332 formed on the retainer 330 with screwing of a screw and thereby rotation transmission from the driving gear 325 to the transmitted member 342 is interrupted. Further, since the protrusion 343 formed on the transmitted member 342 rotates the retainer 330 with screwing a screw, it is not necessary to provide additional members other than the transmitted member 342 and the retainer 340 for rotating the retainer 340.

In the first to the fourth embodiments described above, an inner surface section of the driving gear 125, 225, 325, 425 is defined as a circular section and an outer surface section of the transmitted member 142, 242, 342, 442 is defined as a regular hexagonal section. However it is not limited to such sectional shape. For example, an inner surface section of the driving gear may be defined as a regular hexagonal section and an outer surface section of the transmitted member may be defined as a circular section. Further, instead of the regular hexagonal section, a regular polygonal section may be applicable to the present invention. In this case, the rollers may be provided in accordance with number of sides of the regular polygon.

Fifth Embodiment

Next, a fifth embodiment of the present invention is explained with reference to FIG. 45 and FIG. 46. In a screw driver 500, the same components described in the first embodiment are assigned the same symbols as in the first embodiment and explanations thereof are therefore omitted.

Figure 45:
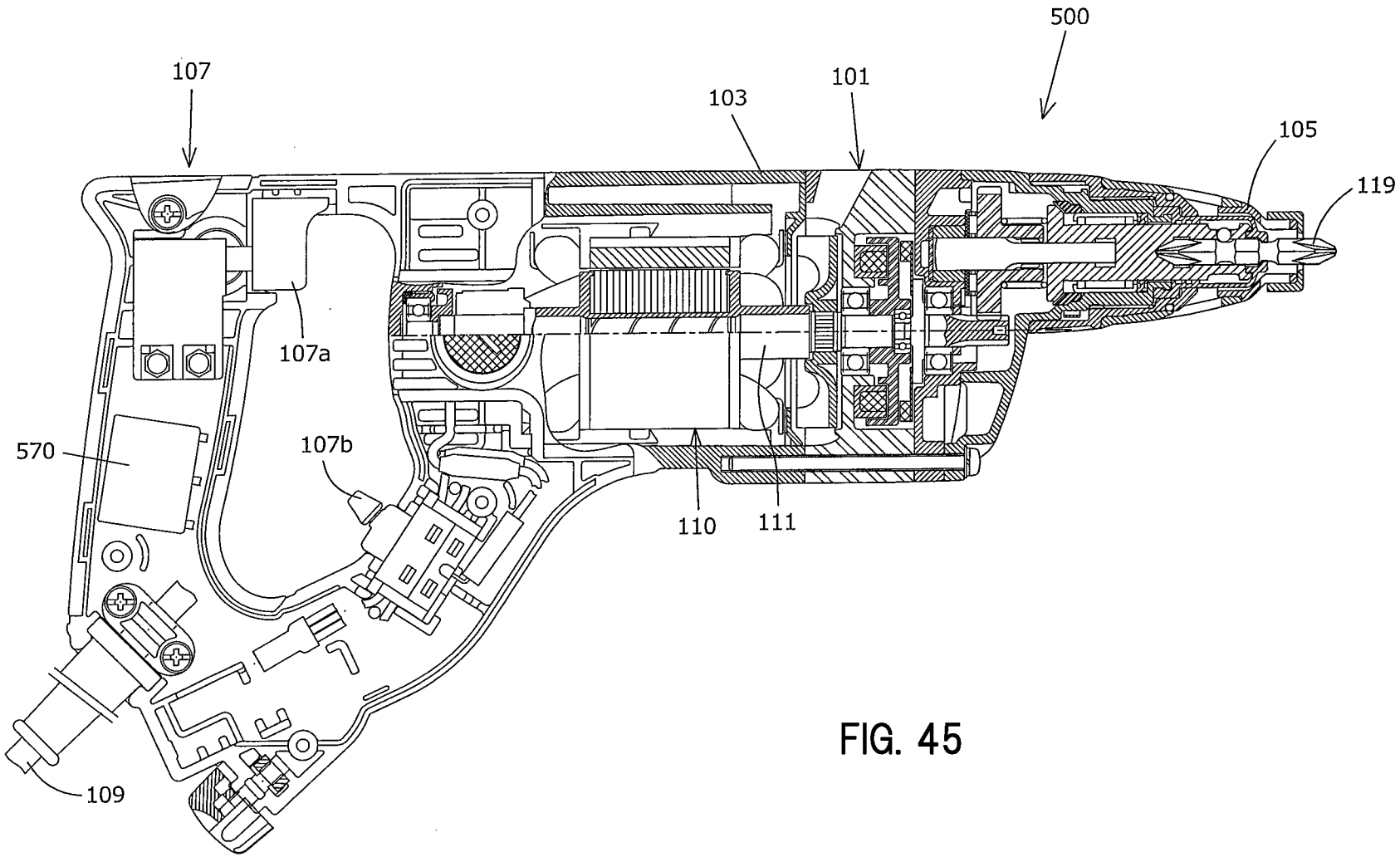
FIG. 45 shows a cross sectional view of a screw driver of a fifth embodiment of the present invention.
Figure 46:
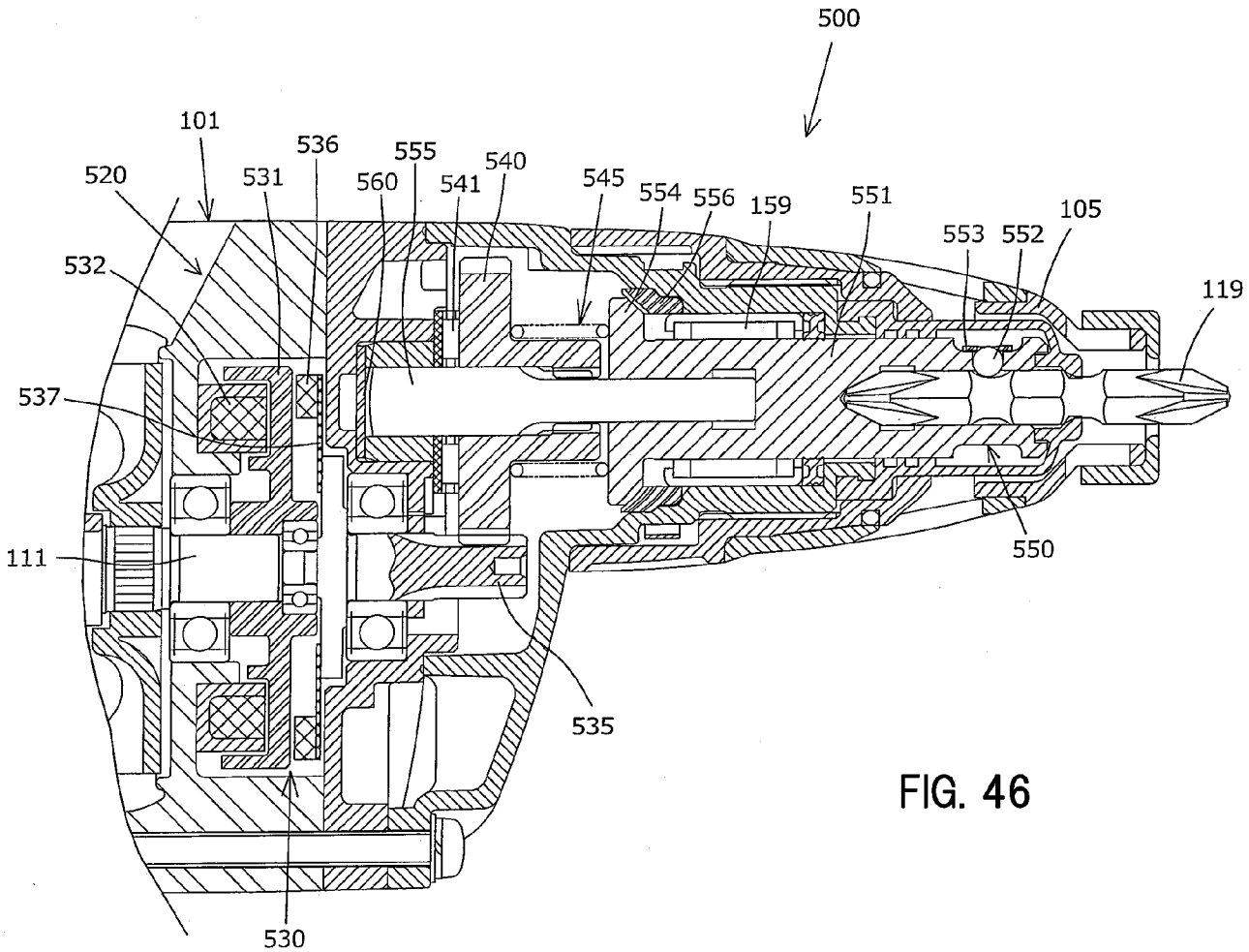
FIG. 46 shows a partial cross sectional view of the screw driver.

As shown in FIG. 45 and FIG. 46, a driving mechanism 520 is mainly provided with a transmission mechanism 530, a driven gear 540, a spindle 550, a load cell 560, and a controller 570. The driving mechanism 520 is one example which corresponds to "a rotation transmitting mechanism" of the present invention.

As shown in FIG. 46, the transmission mechanism 530 is configured to transmit rotation of the output shaft 111 of the motor 110 to the driven gear 540. The transmission mechanism 530 is mainly provided with a rotor 531, an electromagnet 532, a driving gear 535, a driven clutch member 536, and a leaf spring 537.

The rotor 531 is mounted onto the outer surface of the output shaft 111 so that the rotor 531 rotates integrally with the output shaft 111. The electromagnet 532 which is electrically connected to the controller 570 is mounted on the rotor 531. The driving gear 535 is provided coaxially with the output shaft 111 and the driven clutch member 536 is mounted via the leaf spring 537 at a region of the driving gear 535, which is opposite to the rotor 531. The driven clutch member 536 is formed by a magnetic material. When current is not provided to the electromagnet 532, the rotor 531 and the driven clutch member 536 are separated by biasing force of the leaf spring 537. The rotor 531 is one example which corresponds to "a driving member" of the present invention. Further, the driving gear 535 and the driven clutch member 536 are one example which corresponds to "a transmitting member" of the present invention. Further, a position of the driving gear 535 and the driven clutch member 536 which are separated from the rotor 531 is one example which corresponds to "a non-transmittable position" of the present invention.

The driven gear 540 is arranged so as to engage with the driving gear 535. The rotation transmitting shaft 555 penetrates the center of the driven gear 540 and connects with the driven gear 540 by a spline connection. A needle bearing 545 is disposed at rear side of the driven gear 540 and a coil spring 545 is disposed at front side of the driven gear 540. Thus, the driven gear 540 is rotatably supported and biased toward front region of the screw driver 500.

The spindle 550 is mainly provided with a bit holding portion 551 and the rotation transmitting shaft 555. The tool bit 119 is held by the bit holding portion 551 by utilizing a bit holding ball 552 and a leaf spring 553. A flange portion 554 is formed at the opposite side which is opposite to the tool bit 119 side of the bit holding portion 551 in a longitudinal direction of the spindle 550. One end of the rotation transmitting shaft 555 is fixedly connected to the bit holding portion 551, and the other end is extended to the motor 110 side by protruding the driven gear 540. Thus, the bit holding portion 551 and the rotation transmitting shaft 555 are configured to integrally rotate.

The spindle 550 described above is biased forward of the screw driver 500 by the coil spring 545 which contacts with the flange portion 554. A stopper 556 is disposed on the main housing 103 in front of the flange portion 554. The spindle 550 is prevented from moving forward of the screw driver 500 by contacting the flange portion 554 with the stopper 556. On the other hand, the spindle 550 is moved rearward of the screw driver 500 by being pushed against biasing force of the coil spring 545. The spindle 550 is one example which corresponds to "a driven member" of the present invention.

The load cell 560 which is connected to the controller 570 is disposed at a rearward area of the spindle 550. When the rear end of the rotation transmitting shaft 550 contacts with the load cell 560, the load cell 560 detects pushing force of the spindle 550 which is pushed via the tool bit 119.

(Screw Operation)

When the tool bit 119 is pushed on a screw (not shown) in a state that the output shaft 111 of the motor 110 rotates based on an operation (manipulation) of the trigger 107*a*, the spindle 550 is moved rearward of the screw driver 500 against the biasing force of the coil spring 545. Thereafter, the rear end of the rotation transmitting shaft 555 is contacted with the load cell 560 and the controller 570 detects the pushing force of the spindle 550 via the load cell 560. When the pushing force of the spindle 550 exceeds a predetermined threshold, the controller 570 provides current to the electromagnet 532. Accordingly, the driven clutch member 536 disposed on the driving gear 535 is moved by the electromagnetic so that the driving gear 535 and the rotor 531 integrally rotate. As a result, rotation of the output shaft 111 is transmitted to the spindle 550 (tool bit 119) via the transmission mechanism 530, and thereby a screw operation is performed. A rotation direction of the output shaft 111 during the screw operation is one example which corresponds to "a first direction" of the present invention. Further, a position of the driving gear 535 and the driven clutch member 536 which are integrally rotated with the rotor 531 is one example which corresponds to "a transmittable position" of the present invention. Further, the forward position of the spindle 550 and the rearward position of the spindle 550 are examples which correspond to "a first position" and "a second position" of the present invention, respectively. Further, the electromagnet 532 is one example which corresponds to "a switching member" of the present invention.

A front surface of the locator 105 contacts with the workpiece with movement of the screw screwing into the workpiece, the spindle 550 is gradually moved frontward of the screw driver 500. Accordingly, the pushing force detected by the load cell 560 (controller 570) is decreased. When the pushing force falls below the threshold, the controller 570 interrupts a current provision to the electromagnet 532. As a result, the rotor 531 and the driving gear 535 are separated by biasing force of the leaf spring 537, and thereby rotation transmission of the output shaft 111 to the spindle 550 (tool bit 119) is interrupted. Thus, the screw is screwed in a predetermined depth to the workpiece and the screw operation is finished.

(Unscrew Operation)

When a screw screwed into a workpiece is unscrewed from a workpiece, the switch 107*b* is switched so that the output shaft 111 of the motor 110 is rotated in a direction (opposite direction) opposite to the forward direction in which the output shaft 111 is rotated in the screw operation. Thereafter, when the trigger 107*a* is operated, the controller 570 provides current to the electromagnet 532 without detecting the pushing force of the spindle 550. Accordingly, the driven clutch member 536 disposed on the driving gear 535 is moved by the electromagnetic so that the driving gear 535 and the rotor 531 integrally rotate. As a result, rotation of the output shaft 111 is transmitted to the spindle 550 (tool bit 119) via the transmission mechanism 530, and thereby an unscrew operation is performed. That is, the tool bit 119 is driven without the pushing force of the spindle 550. A rotation direction of the output shaft 111 during the unscrew operation is one example which corresponds to "a second direction" of the present invention.

According to the fifth embodiment described above, the tool bit 119 is driven in a state that the tool bit 119 is not pushed against a screw (workpiece). Accordingly, the unscrew operation is rationally performed.

Further, according to the fifth embodiment, both rotations of the A-direction and the B-direction of the driving gear 125 are transmitted by the single transmission mechanism 530. That is, by utilizing the electromagnet 532, one rotation transmission mechanism which transmits rotation of the output shaft 111 in a forward direction to the tool bit 119 in a state that the spindle 550 is pushed and another rotation transmission mechanism which transmits rotation of the output shaft 111 in a opposite direction to the tool bit 119 in a state that the spindle 550 is not pushed are provided by the single transmission mechanism 530. In other words, rotations of both directions of the output shaft 111 are transmitted via the same member. Accordingly, transmission members based on each rotation direction of the output shaft 111 are not needed, and thereby number of components of the screw driver 500 is reduces.

In the fifth embodiment described above, the electromagnet 532 is mounted on the rotor 531 and the driven clutch member 536 is mounted on the driving gear 535, however it is not limited to such construction. For example, an electromagnet may be mounted on the driving gear 535 and a driven clutch member may be mounted on the rotor 531.

Next, a modified example of the fifth embodiment is explained. In the modified example, the output shaft 111 of the motor 110 is configured to engage with the driven bear 540. Further, the motor 110 is connected to the controller 570. During the screw operation, when the trigger 107*a* is operated and the pushing force of the spindle 550 detected by the load cell 570 exceeds the threshold, the controller 570 provides electric current to the motor 110. When the pushing force falls below the threshold, the controller 570 interrupts a provision of electric current to the motor 110, and thereby the screw operation is finished.

On the other hand, during the unscrew operation, when the trigger 107*a* is operated, the controller 570 provides electric current to the motor 110 without detecting the pushing force of the spindle 550. Accordingly, the tool bit 119 is driven without the pushing force. Further, when the operation of the trigger 107*a* is cancelled, the controller 570 interrupts the provision of electric current to the motor 110. Thus, the unscrew operation is rationally performed.

In the first to the fifth embodiments, a moving prevention member which is configured to prevent the spindle 150, 550 from moving rearward of the screw driver 100, 200, 300, 400, 500 during the unscrew operation may be provided. For example, the moving prevention member may be configured to be movable to change its positions based on a switching of the switch 107*b* such that the moving prevention member contacts with the rear surface of the flange portion 154, 554 during the unscrew operation and it does not contact with the flange portion 154, 554 during the screw operation.

Having regard to an aspect of the invention, following features are provided. Each feature may be utilized independently or in conjunction with other feature (s) or claimed invention (s).

(Feature 1)

When the output shaft is rotated in the predetermined first direction and the driven member is positioned in the first position, movement of the switching member in the circumference direction of the rotation shaft with respect to the driven member is prevented by a mechanical engagement.

(Feature 2)

The power tool comprises a biasing member which is configured to bias the axially movable element, wherein the axially movable element prevents the switching member from moving in the circumference direction of the rotation shaft by means of biasing force of the biasing member.

(Feature 3)

The power tool which is configured as a screw fastening tool which performs a screw operation in which the tool bit fastens a screw into a workpiece, comprising:

a workpiece contact portion which is contactable with a workpiece during the screw operation, wherein in a state that the workpiece contact portion contacts with a workpiece, the driven member moves such that protruding amount of the tool bit from the workpiece contact portion in the axial direction of the tool bit is increased by fastening a screw by the tool bit, and wherein the axially movable element moves in the axial direction of the tool bit in accordance with the axial movement of the driven member during the screw operation and thereby the axially movable element moves the switching member in the circumference direction and the switching member switches the position of the transmitting member to the non-transmittable position from the transmittable position.

(Feature 4)

The axially movable element is formed integrally with the driven member.

(Feature 5)

The axially movable element is formed as a spherical member which is a separate member from the driving member.

(Feature 6)

The axially movable element is configured to normally prevent the switching member from moving in the circumference direction with respect to the driven member, wherein the axially movable element is moved in the axial direction by movement of the driven member from the first position to the second position and thereby rotation of the switching member with respect to the driven member in the circumference direction is allowed, and wherein in a state that the rotation of the switching member is allowed, the driving member is rotated and thereby the switching member switches the position of the transmitting member from the non-transmittable position to the transmittable position.

(Feature 7)

One of the axially movable element and the switching member has a guide portion which extends in the circumference direction, and the other has a contact portion which is contactable with the guide portion, wherein in a state that the guide portion and the contact portion contact with each other, the axially movable element moves so as to be close to a workpiece in the axial direction during the screw operation and thereby the switching member is moved in the circumference direction and switches the position of the transmitting member from the transmittable position to the non-transmittable position.

(Feature 8)

One of the driving member and the driven member has a cylindrical column part which faces a polygonal column part of the other member, wherein the transmitting member is provided with a plurality of transmitting elements which is arranged on the each surface of the polygonal column part.

(Feature 9)

The driven member is arranged inside the driving member, wherein an internal form of the driving member is formed as a cylindrical column and an external form of the driven member is formed as a polygonal column, and wherein the transmitting member is provided as a cylindrical roller which is arranged on the each surface of the polygonal column.

(Feature 10)

A power tool which rotationally drives a tool bit, comprising:

a motor which includes an output shaft, and a rotation transmission mechanism which transmits rotation of the output shaft of the tool bit and thereby rotationally drives the tool bit, wherein the rotation transmission mechanism comprises a driving member which includes a rotation shaft, the driving member being normally rotationally driven by the motor, and a driven member to which the tool bit is attached, and wherein the driven member is configured to be moved from a first position to a second position in an axial direction of the tool bit by pushing against a workpiece via the tool bit, when the output shaft is rotated in a predetermined first direction, the driven member is moved in the second position from the first position by pushing against a workpiece via the tool bit and thereby rotation of the output shaft in the first direction is transmitted from the driving member to the driven member, when the output shaft is rotated in a second direction opposed to the first direction, rotation of the output shaft in the second direction is transmitted from the driving member to the driven member in a state that the driven member is positioned in the first position without pushing against a workpiece.

(Feature 11)

The power tool comprises a transmitting member which is disposed between the driving member and the driven member, wherein the transmitting member is configured to transmit both rotation in a first direction of the output shaft and in a second direction which is opposite to the first direction of the output shaft.

A correspondence relation between each components of the embodiments and features of the invention is explained as follows. Further, each embodiment is one example to utilize the invention therefore the invention is not limited to the embodiments.

The screw driver 100, 200, 300, 400, 500 corresponds to "a power tool" of the invention.

The motor 110 corresponds to "a motor" of the invention.

The output shaft 111 corresponds to "an output shaft" of the invention.

The driving mechanism 120, 220, 320, 420, 520 corresponds to "a rotation transmission mechanism" of the invention.

The driving gear 125, 225, 325, 425, 535 corresponds to "a driving member" of the invention.

The spindle 150, 550 corresponds to "a transmitted member" of the invention.

The roller 141, 441*a*, 441*b* corresponds to "a transmitting member" of the invention.

The roller 141, 441*a*, 441*b* corresponds to "a transmitting element" of the invention.

The retainer 130, 230, 330, 430 corresponds to "a switching member" of the invention.

The ball 143 corresponds to "an axially movable element" of the invention.

The ball 143 corresponds to "a contact portion" of the invention.

The protrusion 343 corresponds to "an axially movable element" of the invention.

The protrusion 343 corresponds to "a contact portion" of the invention.

The groove 132, 232, 332, 432 corresponds to "a guide portion" of the invention.

The locator 105 corresponds to "a workpiece contact portion" of the invention.

The rotor 531 corresponds to "a driving member" of the invention.

The driven clutch member 536 corresponds to "a driven member" of the invention.

The electromagnet 532 corresponds to "a switching member" of the invention.

DESCRIPTION OF NUMERALS

100 screw driver
101 main body
103 main housing
105 locator
107 handle
107*a* trigger
107*b* switch
110 motor
111 output shaft
112 gear teeth
119 tool bit
120 driving mechanism
125 driving gear
126 side wall
126*a* gear teeth
127 bottom wall
127*a* contact portion
128 bearing
130 retainer
131 base portion
132 groove
133 horizontal portion
134 incline portion
135 perpendicular portion
136 side portion
137 needle bearing
140 transmitting mechanism
141 roller
142 transmitted member
142*a* ball holding groove
142*b* stopping portion
143 ball
145 coil spring
146 stopper
150 spindle
151 bit holding portion
152 bit holding ball
153 leaf spring
154 flange portion
155 rotation transmitting shaft
156 ball holding groove
159 bearing
200 screw driver
220 driving mechanism
225 driving gear
226 side wall
226*a* gear teeth
227 bottom wall
227*a* contact portion
229 stopper
230 retainer
231 base portion
232 groove
234 incline portion
236 side portion
240 transmitting mechanism
242 transmitted member
242*a* ball holding groove
300 screw driver
320 driving mechanism

325 driving gear
326 side wall
326*a* gear teeth
327 bottom wall
327*a* contact portion
329 stopper
330 retainer
331 base portion
332 groove
334 incline portion
336 side portion
340 transmitting mechanism
342 transmitted member
343 protrusion
400 screw driver
420 driving mechanism
425 driving gear
426 side wall
426*a* gear teeth
427 bottom wall
427*a* contact portion
430 retainer
431 base portion
432 groove
434 incline portion
435 side portion
435*a* wide portion
435*b* narrow portion
436*a* first roller holding portion
436*b* second roller holding portion
440 transmitting mechanism
441*a* first roller
441*b* second roller
442 transmitted member
442*a* ball holding groove
500 screw driver
520 driving mechanism
530 transmission mechanism
531 rotor
532 electromagnet
535 driving gear
536 driven clutch member
537 leaf spring
540 driven gear
541 needle bearing
545 coil spring
550 spindle
551 bit holding portion
553 bit holding ball
554 flange portion
555 rotation transmitting shaft
556 stopper
560 load cell
570 controller

What is claimed is:

1. A power tool which rotationally drives a tool bit, comprising:

a motor which includes an output shaft, and a rotation transmission mechanism which transmits rotation of the output shaft to the tool bit and thereby rotationally drives the tool bit, wherein the rotation transmission mechanism comprises:

a driving member which includes a rotation shaft, the driving member being rotationally driven by the motor, a driven member to which the tool bit is attached, the driven member being disposed coaxially with the rotation shaft, a transmitting member which is disposed between the driving member and the driven member and is movable in a circumference direction of the rotation shaft between a transmittable position in which rotation of the output shaft is transmitted to the driven member via the transmitting member and a non-transmittable position which is different position from the transmittable position in which the transmission of rotation is interrupted, and a switching member which is configured to switch a position of the transmitting member between the transmittable position and the non-transmittable position by moving in the circumference direction of the rotation shaft with respect to the driven member, and wherein the driven member is configured to move between a first position and a second position in an axial direction of the rotation shaft, and wherein the switching member is allowed to move in the circumference direction of the rotation shaft with respect to the driven member based on the position of the driven member in the axial direction of the rotation shaft, and the transmitting member is switched between the transmittable position and the non-transmittable position by the movement of the switching member.

2. The power tool according to claim 1, wherein the driven member is moved to the second position from the first position by pushing against a workpiece via the tool bit, when the output shaft is rotated in a predetermined first direction and the driven member is positioned in the first position, the switching member is prevented from moving in the circumference direction of the rotation shaft and thereby the switching member holds the transmitting member in the non-transmittable member, and when the output shaft is rotated in the first direction and the driven member is moved to the second position from the first position, the switching member is allowed to move in the circumference direction of the rotation shaft and thereby the switching member switches the position of the transmitting member to the transmittable position and the transmitting member transmits rotation of the output shaft in the first direction to the driven member.

3. The power tool according to claim 2, when the output shaft is rotated in a second direction opposed to the first direction and the driven member is positioned in the first position, the switching member is allowed to move in the circumference direction of the rotation shaft and thereby the switching member switches the position of the transmitting member to the transmittable position and the transmitting member transmits rotation of the output shaft in the second direction to the driven member.

4. The power tool according to claim 1, wherein the rotation transmission mechanism includes an axially movable element which is configured to move in the axial direction of the rotation shaft in accordance with movement of the driven member in the axial direction of the rotation shaft, and wherein the axially movable element moves the switching member in the circumference direction of the rotation shaft by moving in the axial direction of the rotation shaft.

5. The power tool according to claim 4, wherein the axially movable element is formed integrally with the driven member.

6. The power tool according to claim 4, wherein the axially movable element is formed as a spherical member which is separated from the driven member.

7. The power tool according to claim 4, wherein the axially movable element is configured to normally prevent a relative movement of the switching member with respect to the driven member in the circumference direction, and wherein the axially movable element is moved in the axial direction of the rotation shaft by movement of the driven member to the second position from the first position and thereby the relative movement of the switching member is allowed, in a state that the relative movement of the switching member is allowed, when the driving member is rotated, the switching member switches the position of the transmitting member to the transmittable position from the non-transmittable position by rotation of the driving member.

8. The power tool according to claim 4, wherein the power tool is constructed as a screw fastening tool which performs a screw operation in which the tool bit fastens a screw into a workpiece, further comprising:

a workpiece contact portion which is contactable with a workpiece during the screw operation, wherein in a state that the workpiece contact portion contacts with a workpiece, the driven member moves to be close to a workpiece in the axial direction of the tool bit by fastening a screw by the tool bit, and wherein the axially movable element moves in the axial direction in accordance with the axial movement of the driven member during the screw operation and thereby the axially movable element moves the switching member in the circumference direction and the switching member switches the position of the transmitting member to the non-transmittable position from the transmittable position.

9. The power tool according to claim 8, wherein one component of the axially movable element and the switching member has a guide portion which extends in the circumference direction of the rotation shaft, and the other component has a contact portion which is contactable with the guide portion, in a state that the guide portion and the contact portion are contacted with each other during the screw operation, the axially movable element moves to be close to the tool bit in the axial direction and thereby the switching member is moved in the circumference direction of the rotation shaft by the axially movable element, and the switching member switches the position of the transmitting member to the transmittable position from the non-transmittable position by movement of switching member in the circumference direction.

10. The power tool according to claim 1, wherein one component of the driving member and the driven member is formed as a cylinder and the other component is formed as a polygonal column arranged coaxially with the cylinder of said one component, and wherein the transmitting member comprises a plurality of transmitting elements each of which is disposed to correspond to each side surface of the polygonal column.

11. The power tool according to claim 10, wherein the driven member is disposed inside the driving member, the inside of the driving member being formed as a cylinder, the outside of the driven member being formed as a polygonal column, and wherein the transmitting element is formed as a roller and each transmitting element is disposed to correspond to each side surface of the polygonal column of the driven member.

12. The power tool according to claim 10, when the output shaft is rotated in the first direction, the transmitting element belonging to a first group is switched to the transmittable position from the non-transmittable position by pushing the driven member against a workpiece via the tool bit, and when the output shaft is rotated in the second direction, in a state that the transmitting element of the first group is held in the non-transmittable position, rest of the transmitting element belonging to a second group being different from the transmitting element of the first group is switched to the transmittable position from the non-transmittable position without pushing the driven member against a workpiece.

13. A power tool which rotationally drives a tool bit, comprising:

a motor which includes an output shaft, and a rotation transmission mechanism which transmits rotation of the output shaft of the motor to the tool bit and thereby rotationally drives the tool bit, wherein the rotation transmission mechanism has a driving member which includes a rotation shaft, the driving member being rotationally driven by the motor, and a driven member to which the tool bit is attached, and wherein the driven member is configured to be moved from a first position to a second position in an axial direction of the tool bit by pushing against a workpiece via the tool bit, when the output shaft is rotated in a predetermined first direction, the driven member is moved in the second position from the first position by pushing against a workpiece via the tool bit and thereby rotation of the output shaft in the first direction is transmitted from the driving member to the driven member, and when the output shaft is rotated in a second direction opposed to the first direction, rotation of the output shaft in the second direction is transmitted from the driving member to the driven member in a state that the driven member is positioned in the first position without pushing against a workpiece.

14. The power tool according to claim 13, wherein the rotation transmitting mechanism includes a transmitting member which is disposed selectively in a transmittable position in which rotation of the output shaft is transmitted to the driven member via the transmitting member and in a non-transmittable position in which the transmission of rotation is interrupted, and wherein the transmitting member is switched in its position between the transmittable position and the non-transmittable position based on a rotation direction of the output shaft and a position of the driven member in the axial direction of the tool bit, when the output shaft is rotated in the first direction, the transmitting member is positioned in the transmittable position by movement of the driven member from the first position to the second position and thereby rotation of the output shaft in the first direction is transmitted to the driven member via the transmitting member, and when the output shaft is rotated in the second direction, the transmitting member is positioned in the transmittable position in a state that the driven member is positioned in the first position and thereby rotation of the output shaft in the second direction is transmitted to the driven member via the transmitting member.

15. The power tool according to claim 14, wherein the rotation transmitting mechanism includes a switching member which is configured to switch the position of the transmitting member between the transmittable position and the non-transmittable position, and wherein the switching member switches the position of the transmitting member between the transmittable position and the non-transmittable position based on the rotation direction of the output shaft and a position of the driven member in the axial direction of the tool bit.

16. The power tool according to claim 15, wherein the switching member switches the position of the transmitting member by moving in a circumference direction of the rotation shaft.

17. The power tool according to claim 16, wherein the rotation transmitting mechanism includes an axially movable element which is configured to move in the axial direction of the tool bit in accordance with movement of the driven member in the axial direction of the tool bit, and wherein the axially movable element moves the switching member in the circumference direction of the rotation shaft by moving in the axial direction of the tool bit.

18. The power tool according to claim 15, wherein the switching member is configured to move the transmitting member in the axial direction of the rotation shaft.

19. The power tool according to claim 18, wherein the switching member switches the position of the transmitting member in the axial direction of the rotation shaft by utilizing magnetic force.

20. The power tool according to claim 15, wherein the power tool is constructed as a screw fastening tool which performs a screw operation in which the tool bit fastens a screw into a workpiece, further comprising:

a workpiece contact portion which is contactable with a workpiece during the screw operation, wherein in a state that the workpiece contact portion contacts with a workpiece, the driven member moves to be close to a workpiece in the axial direction of the tool bit by fastening a screw by the tool bit, and wherein the switching member is configured to switch the position of the transmitting member between the transmittable position and the non-transmittable position based on a position of the driven member which is moving in the axial direction of the tool bit during the screw operation.

* * * * *